US009631400B2

(12) United States Patent
Liu et al.

(10) Patent No.: US 9,631,400 B2
(45) Date of Patent: Apr. 25, 2017

(54) MULTI-MODE LOCK ASSEMBLY

(75) Inventors: Biao Liu, Shanghai (CN); Xuewen Zheng, Shanghai (CN)

(73) Assignee: Schlage Lock Company LLC, Indianapolis, IN (US)

( * ) Notice: Subject to any disclaimer, the term of this patent is extended or adjusted under 35 U.S.C. 154(b) by 494 days.

(21) Appl. No.: 14/004,230

(22) PCT Filed: Mar. 11, 2011

(86) PCT No.: PCT/CN2011/071744
§ 371 (c)(1),
(2), (4) Date: Oct. 10, 2013

(87) PCT Pub. No.: WO2012/122697
PCT Pub. Date: Sep. 20, 2012

(65) Prior Publication Data
US 2014/0047878 A1 Feb. 20, 2014

(51) Int. Cl.
*E05B 55/06* (2006.01)
*E05B 17/04* (2006.01)
(Continued)

(52) U.S. Cl.
CPC ..... *E05B 55/06* (2013.01); *E05B 13/004* (2013.01); *E05B 13/101* (2013.01);
(Continued)

(58) Field of Classification Search
CPC ..... E05B 13/00; E05B 13/002; E05B 13/004; E05B 13/005; E05B 13/007; E05B 13/10;
(Continued)

(56) References Cited

U.S. PATENT DOCUMENTS 3,361,462 A * 1/1968 Foster ..... E05B 55/00 292/153
4,583,382 A * 4/1986 Hull ..... E05B 59/00 70/107

(Continued)

FOREIGN PATENT DOCUMENTS

AU 2004200529 12/2005
CN 2620031 Y 6/2004

(Continued)

OTHER PUBLICATIONS

Further Examination Report from New Zealand Intellectual Property Office for Application No. 616556 dated Mar. 13, 2015 (2 pages).

(Continued)

*Primary Examiner* — Christopher Boswell
(74) *Attorney, Agent, or Firm* — Michael Best & Friedrich LLP

(57) ABSTRACT

A lock assembly (10) that has a first lock state and a second lock state. The lock assembly (10) includes a latch assembly (30) that has a latch (55) movable between an extended position and a retracted position, and a handle operatively coupled to the latch (55) to move the latch (55) between the extended position and the retracted position. The lock assembly (10) also includes a hub that is coupled to the handle for movement therewith, a member that is operatively coupled to the handle to permit or prevent movement of the latch (55) and a lock element. The member is engaged with the hub to permit or prevent movement of the hub. The lock element is engaged with the member in the second lock state such that the member prevents movement of the handle, and the lock element is disengaged from the member in the first lock state such that the member permits movement of the handle.

21 Claims, 30 Drawing Sheets

(51) Int. Cl.

| | |
|---|---|
| ***E05B 13/10*** | (2006.01) |
| ***E05B 47/06*** | (2006.01) |
| ***E05B 63/16*** | (2006.01) |
| ***E05B 13/00*** | (2006.01) |
| *E05B 47/00* | (2006.01) |
| *E05B 15/00* | (2006.01) |
| *G07C 9/00* | (2006.01) |

(52) U.S. Cl.
CPC ..... *E05B 17/045* (2013.01); *E05B 47/0012* (2013.01); *E05B 47/0657* (2013.01); *E05B 63/16* (2013.01); *E05B 15/004* (2013.01); *E05B 15/006* (2013.01); *E05B 15/0033* (2013.01); *E05B 47/0669* (2013.01); *E05B 2047/0026* (2013.01); *E05B 2047/0067* (2013.01); *E05B 2047/0086* (2013.01); *G07C 9/00674* (2013.01); *Y10T 70/70* (2015.04); *Y10T 70/7051* (2015.04); *Y10T 70/7153* (2015.04); *Y10T 70/7559* (2015.04)

(58) Field of Classification Search
CPC .... E05B 13/101; E05B 13/106; E05B 13/108; E05B 17/04; E05B 17/044; E05B 17/045; E05B 55/00; E05B 55/005; E05B 55/06; E05B 2047/0026; E05B 2047/0027; E05B 2047/0028; E05B 2047/003; E05B 2047/0031; E05B 2047/0032; E05B 2047/0033; E05B 2047/0034
See application file for complete search history.

(56) References Cited

U.S. PATENT DOCUMENTS

| | | | | |
|---|---|---|---|---|
| 4,674,776 | A * | 6/1987 | James | E05B 13/004 292/150 |
| 5,474,348 | A * | 12/1995 | Palmer | E05B 47/0012 292/144 |
| 5,678,870 | A * | 10/1997 | Pelletier | E05B 55/12 292/169.16 |
| 6,619,705 | B2 * | 9/2003 | Dalsing | E05B 47/0688 292/169.14 |
| 7,051,561 | B2 * | 5/2006 | Moon | E05B 47/0673 340/5.6 |
| 7,188,870 | B2 * | 3/2007 | Huang | E05B 55/12 292/163 |
| 7,497,486 | B1 * | 3/2009 | Davis | E05B 15/0205 292/169.14 |
| 7,870,770 | B2 | 1/2011 | Blanch | |
| 8,997,534 | B2 * | 4/2015 | Rai | E05B 65/00 292/169.14 |
| 2007/0051143 | A1 | 3/2007 | Raatikainen et al. | |
| 2009/0056391 | A1 | 3/2009 | Mathachan | |

FOREIGN PATENT DOCUMENTS

| | | | |
|---|---|---|---|
| CN | 2651379 | Y | 10/2004 |
| CN | 200968111 | | 10/2007 |
| CN | 200968111 | Y | 10/2007 |
| CN | 201339367 | Y | 11/2009 |
| NZ | 244230 | | 10/1995 |
| NZ | 270159 | | 10/1996 |
| NZ | 270160 | | 10/1996 |
| NZ | 288529 | | 1/1998 |
| NZ | 248450 | | 3/1998 |
| NZ | 501925 | | 3/2001 |
| NZ | 517337 | | 3/2002 |
| NZ | 505346 | | 8/2002 |
| NZ | 508725 | | 9/2002 |
| NZ | 522198 | | 8/2004 |
| NZ | 520857 | | 5/2005 |
| NZ | 537443 | | 12/2005 |
| NZ | 541200 | | 4/2006 |
| NZ | 548681 | | 12/2007 |
| NZ | 563185 | | 7/2008 |
| NZ | 538561 | | 1/2009 |
| NZ | 562711 | | 9/2009 |
| NZ | 576939 | | 9/2010 |
| WO | 2009032839 | | 3/2009 |

OTHER PUBLICATIONS

First Examination Report from New Zealand Intellectual Property Office for Application No. 616556 dated Jul. 11, 2014 (2 pages).
International Search Report and Written Opinion for corresponding International Application No. PCT/CN2011/071744 mailed on Dec. 22, 2011.
EP11860941.1 Extended European Search Report dated Jan. 2, 2017 (8 pages).

* cited by examiner

MULTI-MODE LOCK ASSEMBLY

BACKGROUND

The present invention relates to a lock assembly, and more particularly, to a lock assembly including two or three lock states.

Conventional lock assemblies generally include an outer handle and an inner handle respectively attached to the outside and the inside of a door or other structure so that a latch or bolt can be retracted by turning either one of the outer handle and the inner handle. Some lock assemblies include three lock modes or states that control whether the outer handle and/or the inner handle can be used to open the door. In these lock assemblies, the outer and inner handles each have a hub that rotates in response to rotation of the corresponding handle, which in turn can retract the latch in the appropriate lock state. A lock bar is directly engageable with these hubs to selectively allow or prevent retraction of the latch depending on the lock state of the lock assembly.

SUMMARY

The invention provides a lock assembly that has a first lock state and a second lock state. The lock assembly includes a latch assembly that has a latch movable between an extended position and a retracted position, and a handle operatively coupled to the latch to move the latch between the extended position and the retracted position. The lock assembly also includes a hub that is coupled to the handle for movement therewith, a member that is operatively coupled to the handle to permit or prevent movement of the latch, and a lock element. The member is engaged with the hub to permit or prevent movement of the hub. The lock element is engaged with the member in the second lock state such that the member prevents movement of the handle, and the lock element is disengaged from the member in the first lock state such that the member permits movement of the handle.

In another construction, the lock assembly a first lock state and a second lock state, and the lock assembly includes a latch assembly, a handle, and a movable member. The latch assembly has a latch that is movable between an extended position and a retracted position. The handle is operatively coupled to the latch to move the latch between the extended position and the retracted position. The lock assembly also includes a lock element that is disengaged from the member in the first lock state, and that is engaged with the member in the second lock state, and a blocking element between the handle and the member. The blocking element cooperates with the member to permit or prevent movement of the latch between the extended position and the retracted position.

In another construction, the lock assembly has an unlocked state, a locked state, and a deadlocked state. The lock assembly includes a latch assembly that has a latch movable between an extended position and a retracted position, an interior handle operatively coupled to the latch to move the latch between the extended position and the retracted position, and an exterior handle operatively coupled to the latch to move the latch between the extended position and the retracted position. The lock assembly also includes a first member that is operatively coupled to the interior handle to permit or prevent movement of the interior handle, a second member that is operatively coupled to the exterior handle to permit or prevent movement of the exterior handle, an interior lock element that is engageable with the first member, and an exterior lock element that is engageable with the second member. When the lock assembly is in the unlocked state, the interior lock element is disengaged from the first member and the exterior lock element is disengaged from the second member to permit retraction of the latch via the interior handle or the exterior handle. When the lock assembly is in the locked state, the exterior lock element is engaged with the second member to prevent retraction of the latch via the exterior handle. When the lock assembly is in the deadlocked state, the interior lock element is engaged with the first member to prevent retraction of the latch via the interior handle and the exterior lock element is engaged with the second member to prevent retraction of the latch via the exterior handle.

In another construction, the invention provides a lock system including a lock assembly that is variable between an unlocked state, a locked state, and a deadlocked state, and a network system including a mesh network in communication with the lock assembly. The lock assembly includes a latch assembly that has a latch movable between an extended position and a retracted position, an interior handle operatively coupled to the latch to move the latch between the extended position and the retracted position, and an exterior handle operatively coupled to the latch to move the latch between the extended position and the retracted position. The lock assembly also includes a first member operatively coupled to the interior handle to permit or prevent movement of the interior handle, a second member operatively coupled to the exterior handle to permit or prevent movement of the exterior handle, an interior lock element engageable with the first member, and an exterior lock element engageable with the second member. The lock assembly is responsive to a remote signal from the mesh network such that the interior lock element is engaged with the first member and the exterior lock element is engaged with the second member, and the lock assembly is further responsive to another remote signal from the mesh network such that the interior lock element is disengaged from the first member and the exterior lock element is disengaged from the second member. The lock assembly is in one of the locked state and the deadlocked state when the interior lock element is engaged with the first member and the exterior lock element is engaged with the second member to prevent retraction of the latch via at least the exterior handle, and the lock assembly is in the unlocked state when the interior lock element is disengaged from the first member and the exterior lock element is disengaged from the second member to permit retraction of the latch via the interior handle or the exterior handle.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
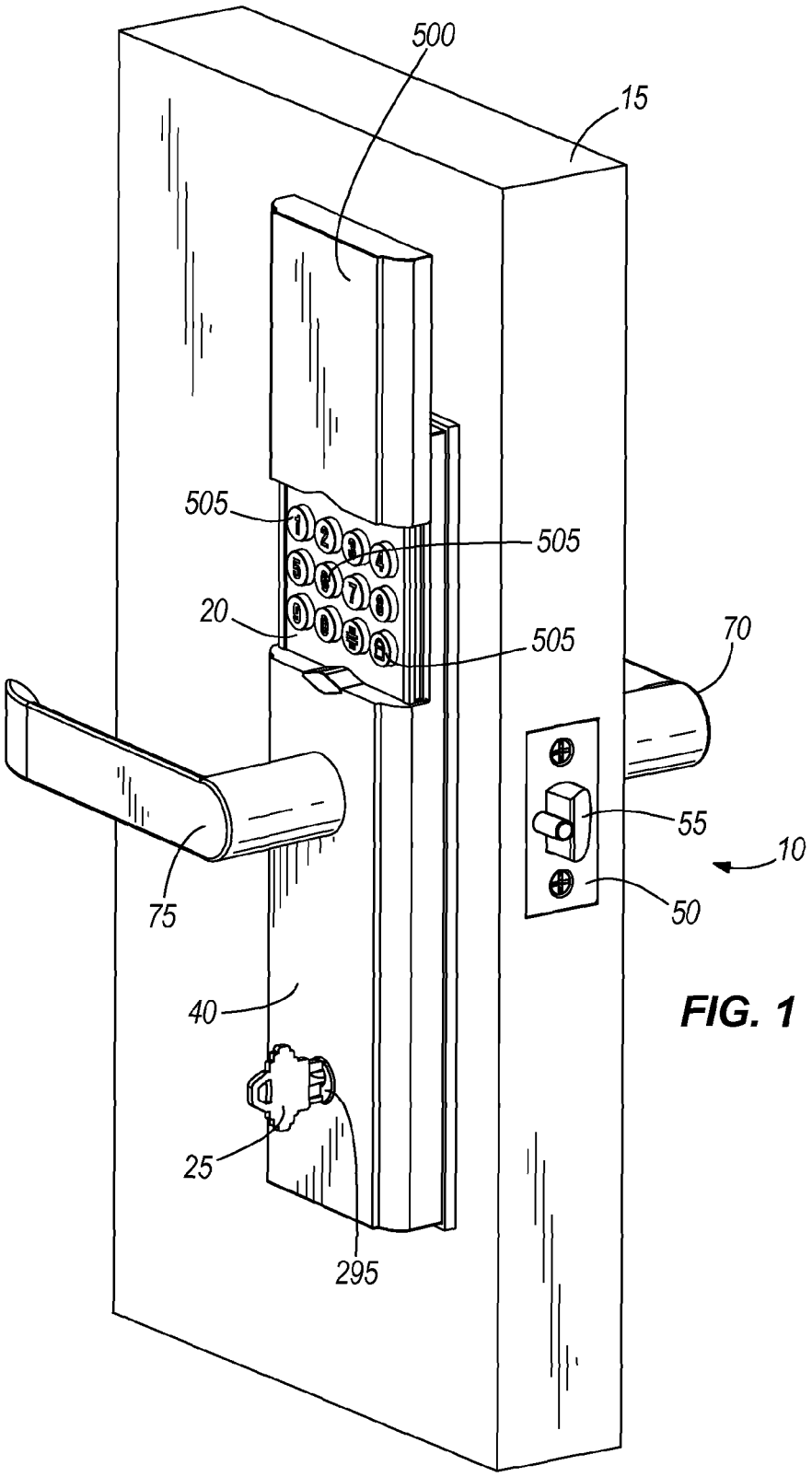
FIG. 1 is a perspective view of a lock assembly embodying the invention and coupled to a structure.
Figure 24:
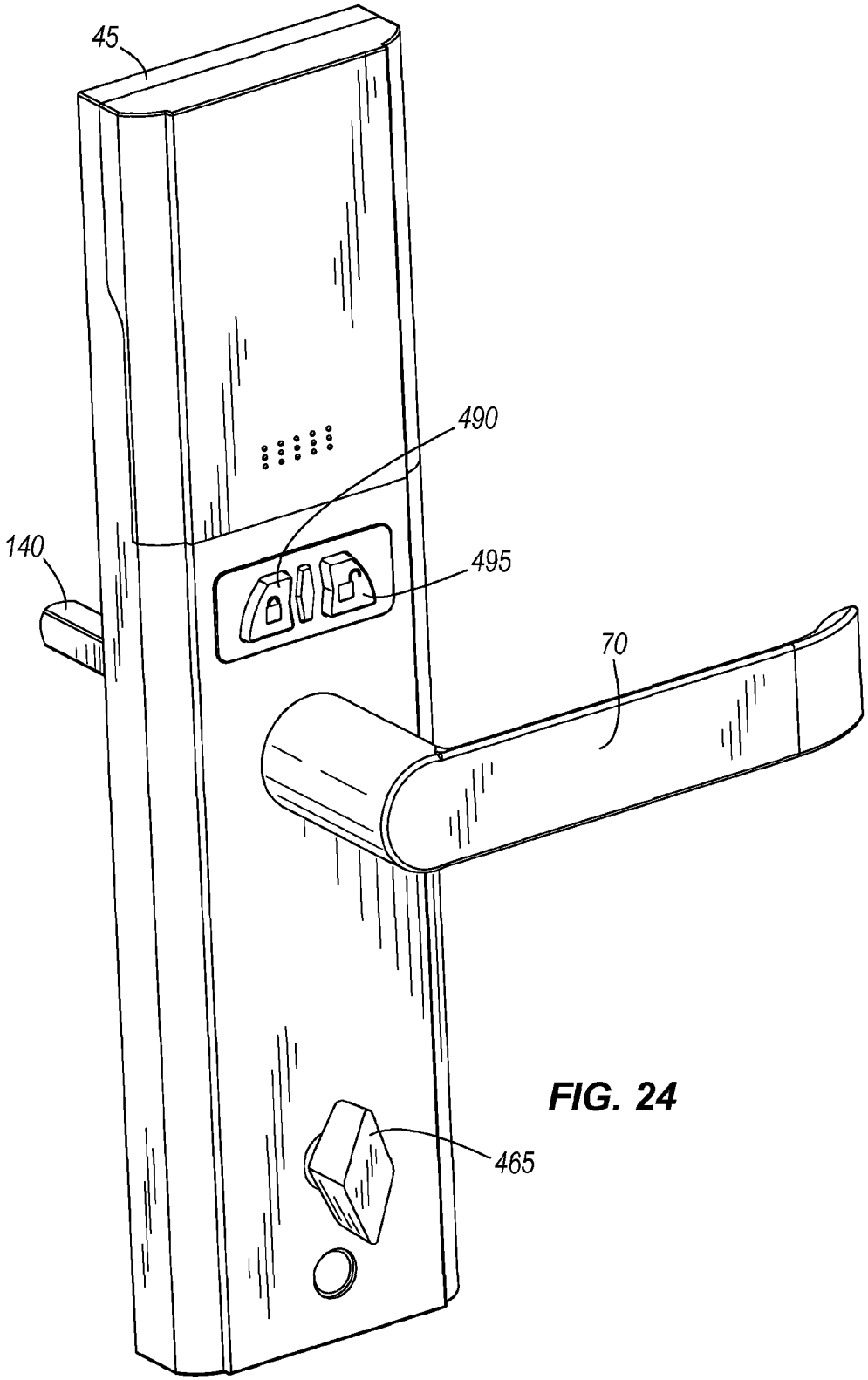
FIG. 24 is a perspective view of the interior escutcheon including a thumbturn actuator accessible from adjacent the interior handle.

FIG. 1 shows a lock assembly 10 for use with a structure (e.g., door, access panel, portable locks, etc.) that may be locked and unlocked. Hereinafter, the term "door" shall be used to represent all such lockable structures and shall not be construed to limit the invention's application solely to doors. The lock assembly 10 illustrated in FIG. 1 can be varied between an unlocked state, a locked state, and a deadlocked state electronically via a keypad 20, mechanically using an appropriate key 25. As illustrated in FIG. 24, the lock assembly 10 can be varied between the unlocked state, the locked state, and the deadlocked state via a thumbturn 465. In some constructions, the lock assembly 10 can be varied between two lock states (e.g., the unlocked state and the locked state, or the unlocked state and the deadlocked state).

Figure 2:
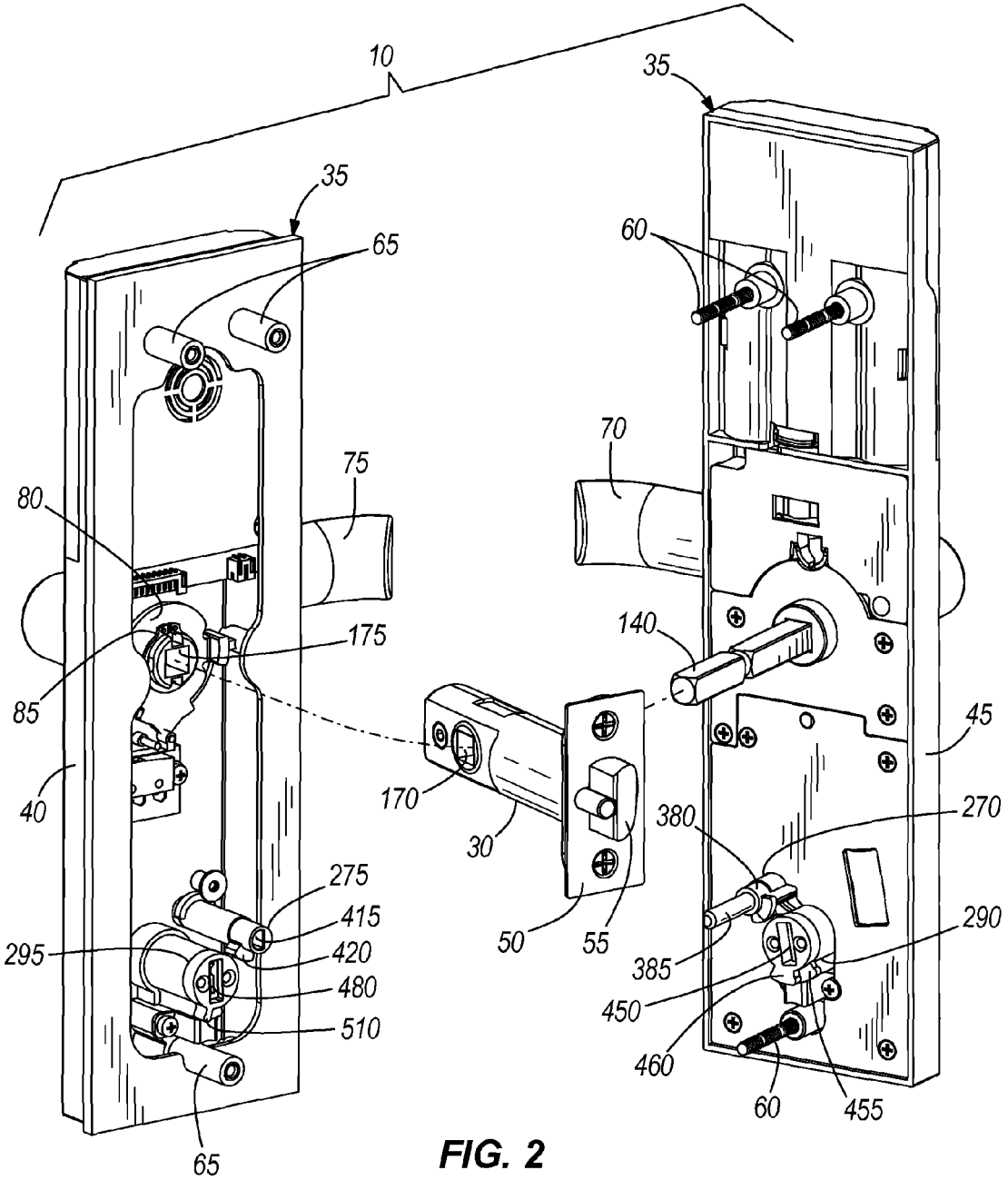
FIG. 2 is an exploded perspective view of the lock assembly of FIG. 1 including an exterior escutcheon, a latch assembly, an interior escutcheon, and exterior and interior handles.

FIGS. 1 and 2 show that the lock assembly 10 includes a latch assembly 30 disposed in a bore (not shown) of the door 15, and an escutcheon assembly 35 that has an exterior escutcheon 40 and an interior escutcheon 45 substantially enclosing the latch assembly 30 in the door 15. The latch assembly 30 includes a latch plate 50 and a latch 55 that is movable between an extended position and a retracted position relative to the latch plate 50 such that when the latch 55 is in the extended position, the latch 55 engages a pocket (e.g., strike plate—not shown) in a frame (not shown) of the door 15 to hold the door 15 in a closed position. The latch 55 is movable to the retracted position to allow the door 15 to move to an open position. Such latch assembly 30 arrangements are well known in the art.

The exterior escutcheon 40 and the interior escutcheon 45 are attached to each other and held in engagement with the door 15 by fasteners 60 and fastener attachment portions 65. The illustrated fasteners 60 are coupled to the interior escutcheon 45 and the fastener attachment portions 65 are coupled to the exterior escutcheon 40. In other constructions, the fasteners 60 can be located on one or both the exterior escutcheon 40 and the interior escutcheon 45, with the fastener attachment portions 65 on the complementary portion of the other escutcheon 40, 45 to which the fasteners 60 are not coupled.

FIGS. 1 and 2 show that the lock assembly 10 includes an interior handle 70 and an exterior handle 75 that are operatively coupled to the latch assembly 30 to extend and retract the latch 55. As illustrated in FIG. 2, the exterior handle 75 is rotatably coupled to the exterior escutcheon 40 via a plate 80 and a snap ring 85. As illustrated, the plate 80 has an oblong shape and rotates with the exterior handle 75. Although not illustrated, the interior handle 70 is rotatably coupled to the interior escutcheon 45 in a similar manner. The interior handle 70 and the exterior handle 75 are movable (e.g., pivotable or rotatable) between an inactive state in which the corresponding handle 70, 75 is not moved, and an active state in which the corresponding handle 70, 75 is being moved. Generally, the latch 55 is in the extended position when the interior and exterior handles 70, 75 are in the inactive state, and the latch 55 is movable toward the retracted position when the interior handle 70 or the exterior handle 75 is in the active state.

As shown in FIGS. 4, 11-13, and 23, the lock assembly 10 also includes an interior hub 90 and an exterior hub 95. The interior hub 90 has a first spindle 100 that extends outward from a first side of the interior hub 90, a projection 105 that extends inward from a second side of the interior hub 90, and a first circumferential recess 110 that is located on a perimeter of the interior hub 90. The interior hub 90 is operatively connected to the interior handle 70 via the first spindle 100 so that the interior hub 90 rotates with the interior handle 70. As illustrated in FIGS. 11-13, 25, and 26, the projection 105 is defined by opposed projection portions 115, and the first circumferential recess 110 is defined by opposed ramped surfaces 120 that define an angle greater than 90 degrees, although other angles are possible and considered herein. The ramped surfaces 120 interface with the perimeter of the interior hub 90 at respective transition points 125.

The exterior hub 95 has an axial recess 130, a second circumferential recess 135, and a second spindle 140. With continued reference to FIGS. 11-13, 25, and 26, the axial recess 130 is defined by angularly offset engagement surfaces 145 and curved surfaces 150 extending between the engagement surfaces 145. As illustrated, the second circumferential recess 135 is defined by opposed ramped surfaces 160 that define an angle greater than 90 degrees, although other angles are possible and considered herein. The ramped surfaces 160 interface with the perimeter of the interior hub 90 at respective transition points 165. The interior hub 90 and the exterior hub 95 are coupled together such that the transition points 125 of the first circumferential recess 110 align with the transition points 165 of the second circumferential recess 135 when the interior and exterior handles 70, 75 are both in the inactive state.

The exterior hub 95 is operatively connected to the exterior handle 75 via the second spindle 140 so that the exterior hub 95 generally rotates with the exterior handle 75. As shown in FIG. 2, the second spindle 140 extends from the interior escutcheon 45 through an opening 170 in the latch assembly 30 into an aperture 175 in the exterior handle 75. Generally, the second spindle 140 is engaged with the latch assembly 30 within the opening 170 to vary the latch 55 between the extended position and the retracted position in response to rotation of the interior handle 70 or the exterior handle 75.

The projection 105 has a cross-sectional shape that is similar to the cross-sectional shape of the axial recess 130. As illustrated in FIGS. 12, 13, 25, and 26, the projection 105 is sized smaller than the axial recess 130 to provide an initial lost rotative motion between the interior hub 90 and the exterior hub 95 when the interior handle 70 or the exterior handle 75 is rotated. In the illustrated construction, the interior hub 90 is biased such that the projection portions 115 are substantially centered between the engagement surfaces 145 when the interior handle 70 and the exterior handle 75 are in their respective inactive states. In some constructions, the attachment between the interior hub 90 and the exterior hub 95 can be reversed (e.g., the interior hub 90 can have the axial recess 130 and the exterior hub 95 can have the projection 105).

Figure 12:
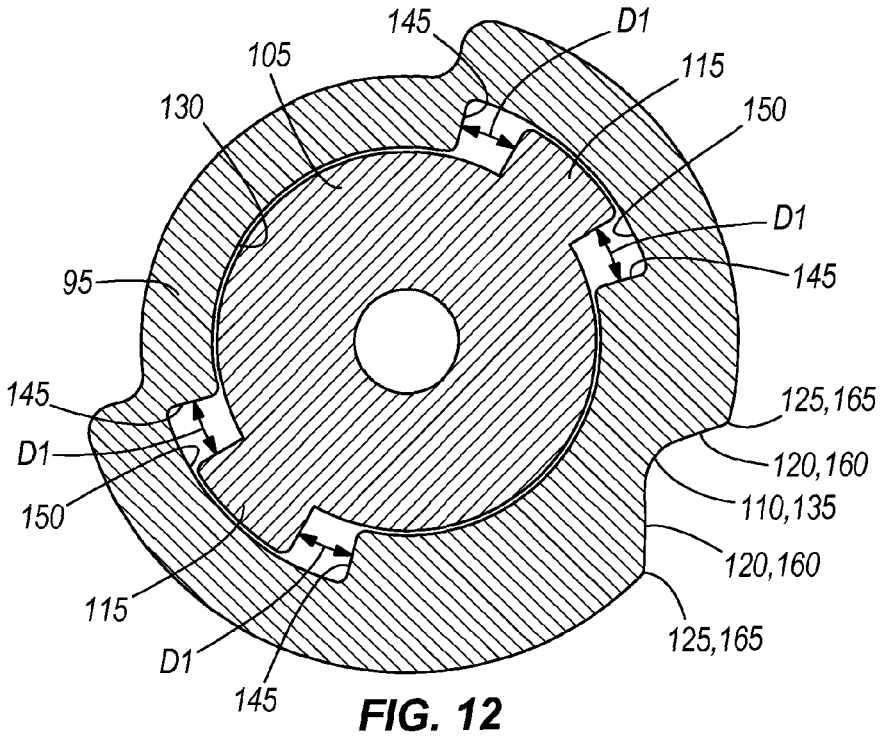
FIG. 12 is a section view of illustrating the exterior hub engaged with the interior hub when the interior handle and the exterior handle are in an inactive state.
Figure 13:
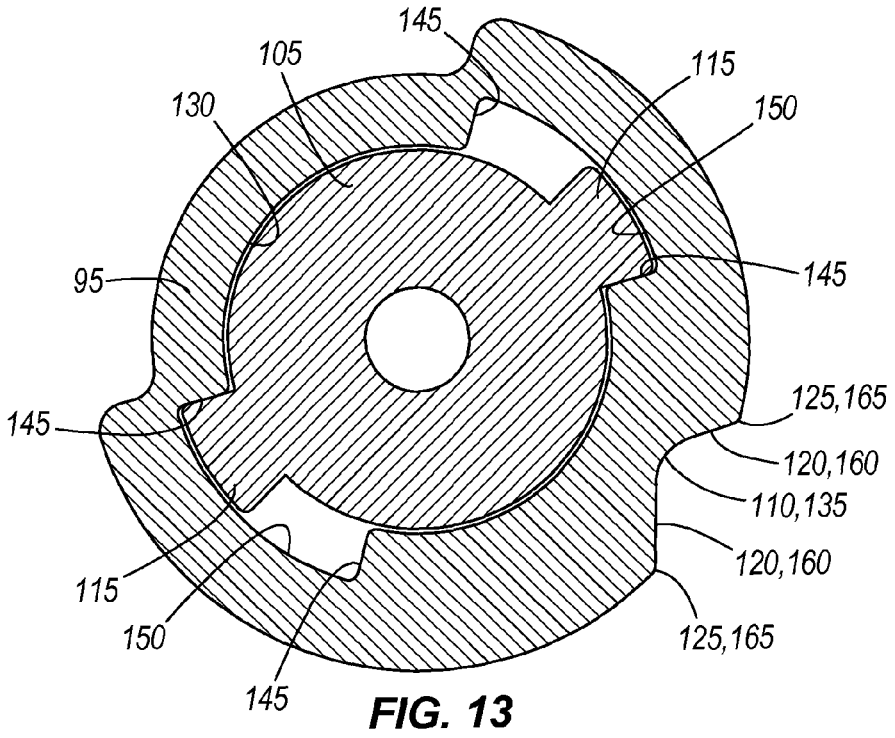
FIG. 13 is a section view illustrating the exterior hub engaged with the interior hub when one of the interior handle and the exterior handle is in an active state.

With reference to FIGS. 12 and 13, the initial lost rotative motion defines an angular distance D1 that the interior hub 90 rotates relative to the exterior hub 95, or that the exterior hub 95 rotates relative to interior hub 90. In the illustrated construction, the angular distance D1 is approximately 15 degrees. In other constructions, the initial lost rotative motion provided by engagement of the projection 105 in the axial recess 130 can include other angular distances (e.g., a distance corresponding to approximately 10 degrees of lost rotative motion) between the interior and exterior hubs 90, 95.

Figure 3:
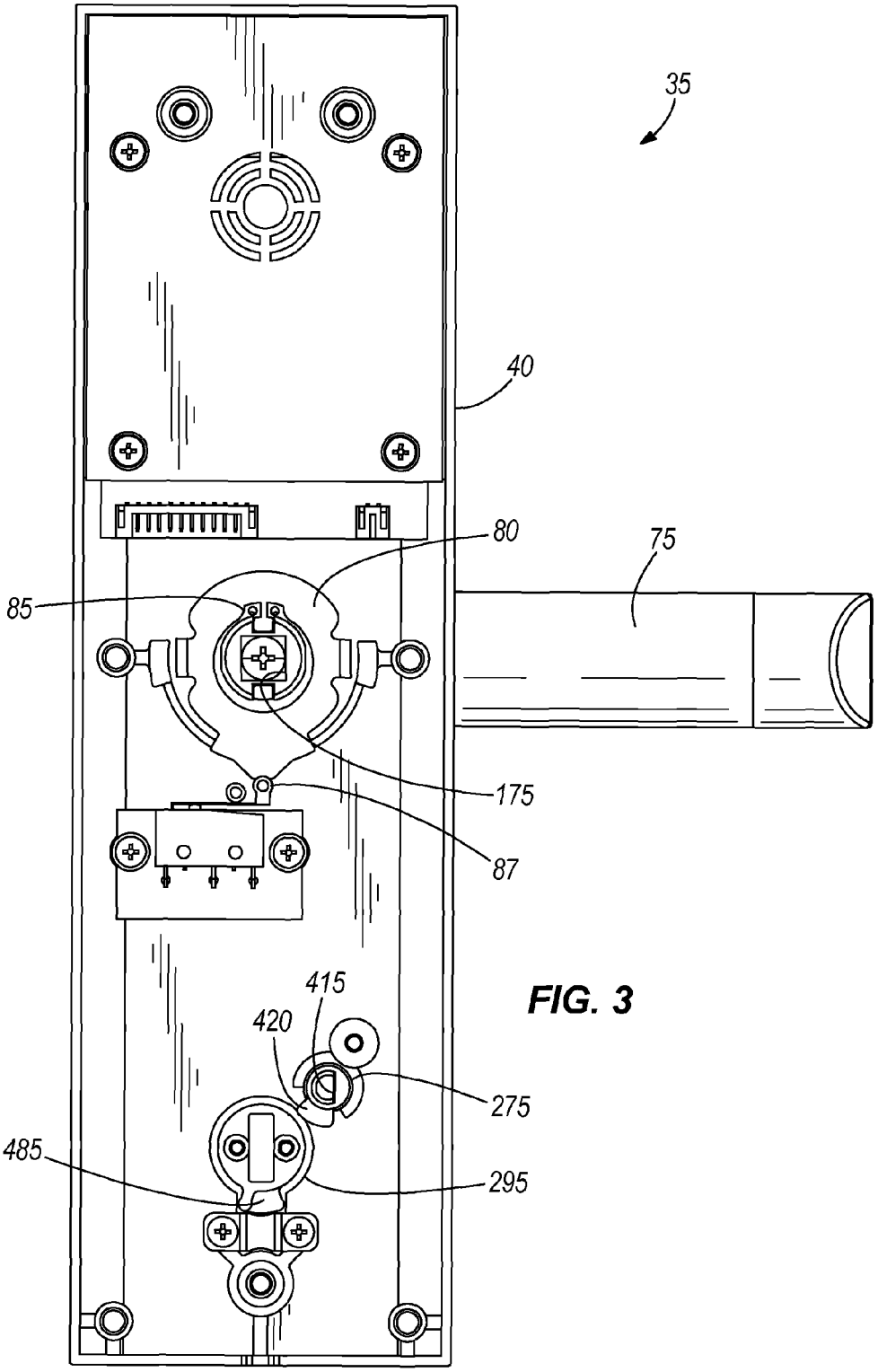
FIG. 3 is a rear view of the exterior escutcheon including an exterior lock cylinder and an exterior drive member.

As shown in FIG. 3, the lock assembly 10 includes a handle sensor 87 that is in communication with the interior handle and the exterior handle 75 via the plate 80. Generally, the handle sensor 87 detects whether the interior handle 70 or the exterior handle 75 is in the inactive state or the active state based on the rotational position of the plate 80.

With reference to FIGS. 4, 23, 25, and 26, the lock assembly 10 also includes an interior blocking element or ram member 180, an exterior blocking element ram member 185, an interior blocking member or slide member 190, and an exterior blocking member or slide member 195. The interior ram member 180 has a first portion 200 that is engaged with the interior hub 90 within the first circumferential recess 110, and a second portion 205 that is substantially opposite the first portion 200 and that is engaged with the interior slide member 190. The interior ram member 180 is pivotable relative to the escutcheon assembly 35 in response to rotation of the interior hub 90 such that the first portion 200 is disengageable from the first circumferential recess 110 when the interior handle 70 is rotated.

The exterior ram member 185 is defined by the same shape as the interior ram member 180. In particular, the exterior ram member 185 has a first portion 210 that is engaged with the exterior hub 95 within the second circumferential recess 135, and a second portion 215 that is substantially opposite the first portion 210 and that is engaged with the exterior slide member 195. The exterior ram member 185 is pivotable relative to the escutcheon assembly 35 in response to rotation of the exterior hub 95 such that the first portion 210 is disengageable from the second circumferential recess 135 when the exterior handle 75 is rotated.

Figure 4:
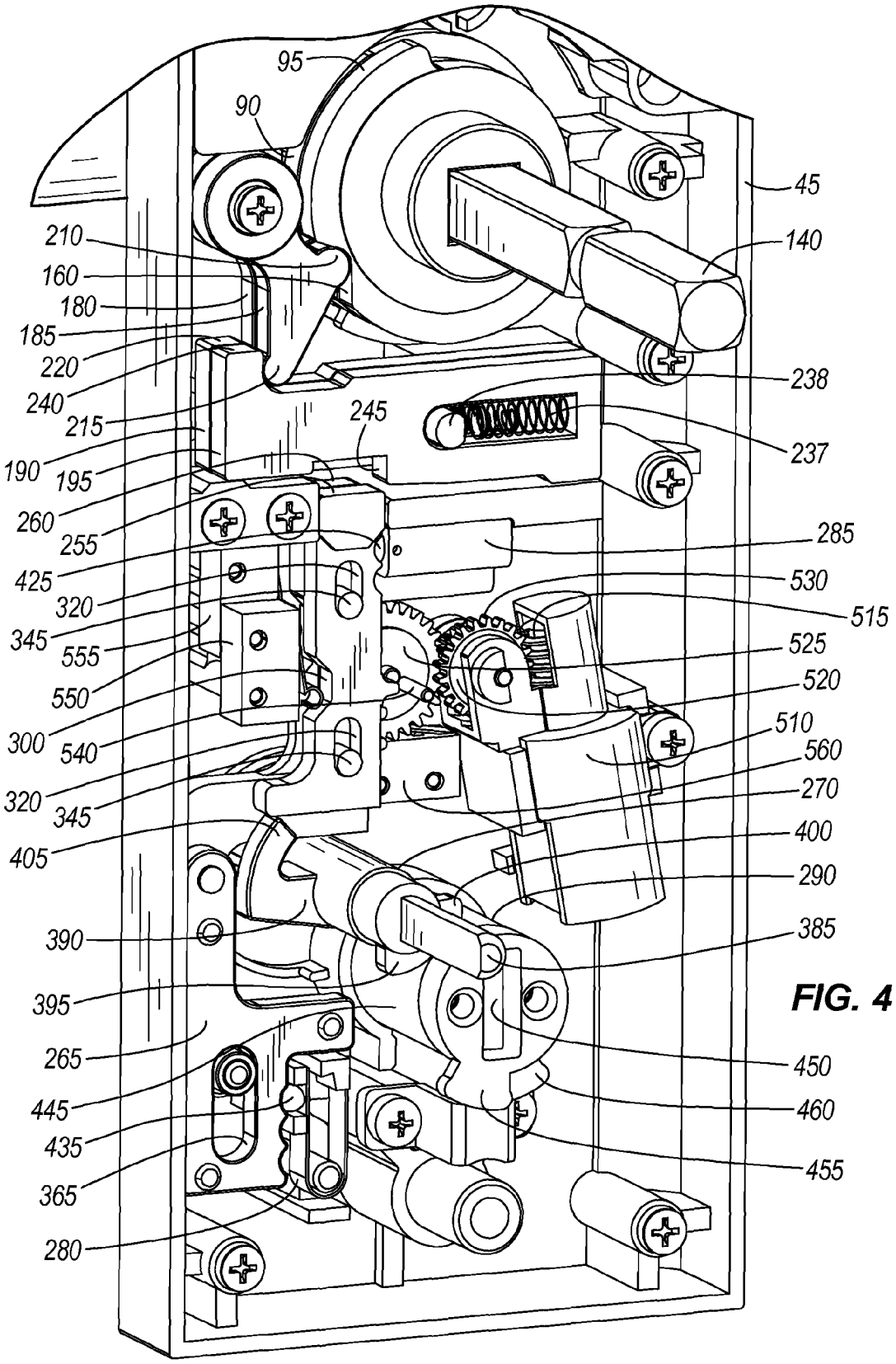
FIG. 4 is a perspective view of a portion of the interior escutcheon.
Figure 23:
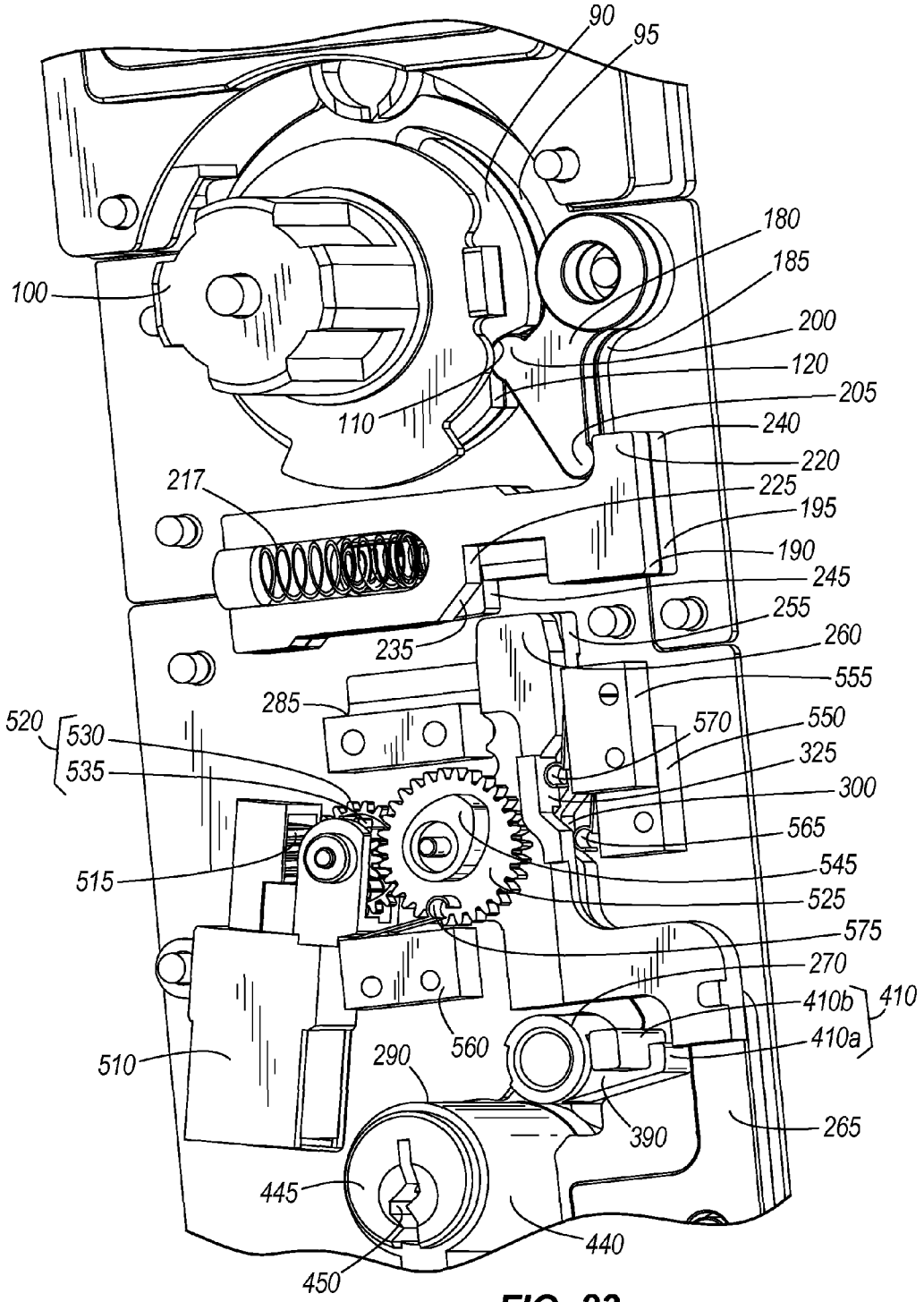
FIG. 23 is a perspective view of a portion of the lock assembly viewed from adjacent the interior escutcheon.

The interior slide member 190 is operatively coupled to the interior hub 90 via engagement with the interior ram member 180 to permit or prevent movement of the interior handle 70. As illustrated in FIGS. 5-10 and 15-20, the interior slide member 190 is biased toward the right by a spring 217. As illustrated in FIGS. 4 and 23, the interior slide member 190 includes a first tab 220, a first slot 225, and a chamfered portion 235. The first tab 220 is engaged by the second portion of the interior ram member 205. The first slot 225 is disposed in a side of the interior slide member 190 and is located between the ends of the interior slide member 190. The first slot 225 is defined by a depth measured from the side of the interior slide member 190 (the lower side as viewed in FIGS. 4-10, 15-20, and 23), and the chamfered portion 235 is located adjacent and on one side of the first slot 225. The interior slide member 190 is movable or slidable in response to movement of the interior ram member 180.

The exterior slide member 195 is operatively coupled to the exterior hub 95 via engagement with the exterior ram member 185 to permit or prevent movement of the exterior handle 75. As illustrated in FIGS. 5-10 and 15-20, the exterior slide member 195 is biased toward the right by a spring 237 acting on a slide pin 238. The exterior slide member 195 includes a second tab 240 that is engaged by the second portion 215 of the exterior ram member 185, and a second slot 245 that is disposed in a side of the exterior slide member 195. The second slot 245 is located between the ends of the exterior slide member 195, and is defined by a depth measured from the side of the interior slide member 190 (the lower side as viewed in FIGS. 4-10 and 15-20). As illustrated in FIG. 4, for example, the depth of the second slot 250 is shallower than the depth of the first slot 230. The exterior slide member 195 is movable or slidable in response to movement of the exterior ram member 185.

With reference to FIGS. 2-10, 15-20, 23, 25, and 26, the lock assembly 10 further includes an exterior lock element or bar 255, an interior lock element or bar 260, a link 265, an interior drive member 270, an exterior drive member 275, an interior locator 280, an exterior locator 285, an interior lock cylinder 290, and an exterior lock cylinder 295. The exterior lock bar 255 is defined by an elongated body that has a first end engageable with the exterior slide member 195 within the second slot 245, and a second end opposite the first end. As illustrated, the first end of the exterior lock bar 255 is generally thicker than the remaining portions of the exterior lock bar 255 (e.g., to strengthen the first end). The exterior lock bar 255 includes a first sensor recess 300 that is disposed along a first edge of the elongated body of the exterior lock bar 255, two exterior locator notches or detents 305 that are disposed along a second edge of the elongated body opposite the first edge, and a first tooth 310 that is disposed along the second edge and spaced apart from the detents 305. The first tooth 305 defines an engagement portion on the edge of the exterior lock bar 255.

The exterior lock bar 255 further includes a first engagement portion 315 that is located adjacent the second end, and pin channels 320 that are oriented longitudinally on the exterior lock bar 255. As illustrated, the pin channels 320 have the same length. In some constructions, the exterior lock bar may include a single pin channel 320. The exterior lock bar 255 is movable between a first position (FIG. 4) in which the exterior lock bar 255 is disengaged from the exterior slide member 195, and a second position (FIGS. 5 and 6) in which the exterior lock bar 255 is engaged with the exterior slide member 195 within the second slot 245.

The interior lock bar 260 is defined by an elongated body that has a first end engageable with the interior slide member 190 within the first slot 225 and a second end opposite the first end. As illustrated, the first end of the interior lock bar 260 is generally thinner than the remaining portions of the interior lock bar 260 (e.g., to avoid interference with the first slot 225). The interior lock bar 260 includes a second sensor recess 325 that is disposed along a first edge of the elongated body, and a second tooth 335 and a third tooth 340 disposed along the second edge. The second tooth 335 and the third tooth 340 define engagement portions on the edge of the interior lock bar 260.

The interior lock bar 260 further includes spaced apart pins 345 on and extending outward from the elongated body, and a second engagement portion 350 that is located adjacent the second end. The pin channels 320 and the pins 345 cooperate to slidably engage the interior lock bar 260 with the exterior lock bar 255, and the pins 345 are movable within the pin channels 320 such that the interior lock bar 260 is movable with and selectively slidable relative to the exterior lock bar 255 to vary the lock assembly 10 between the unlocked state, the locked state, and the deadlocked state. In other constructions, the interior lock bar can include a single pin 345 cooperating with the single pin channel 320 to couple the interior lock bar 260 with the interior lock bar 255.

Figure 6:
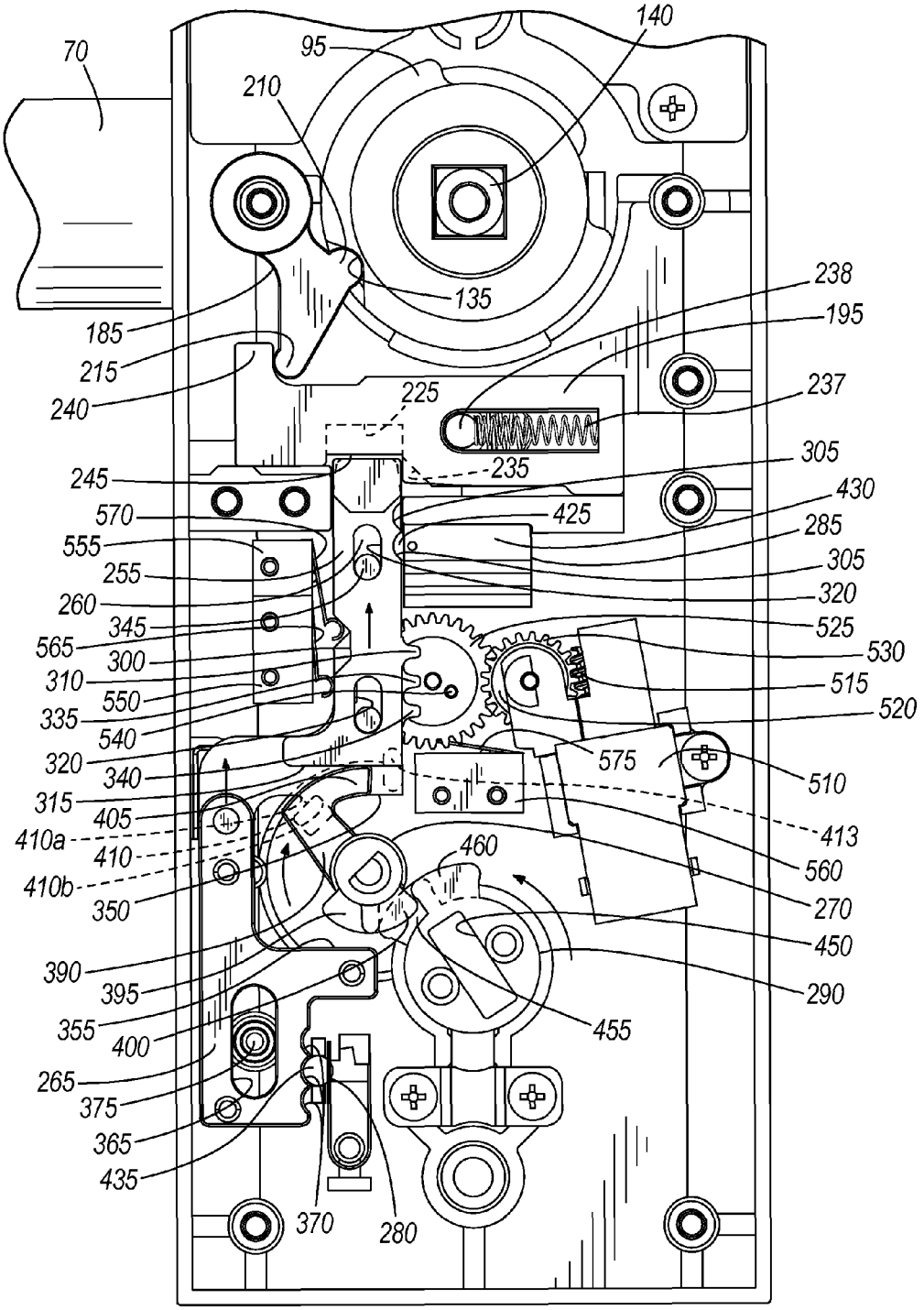
FIG. 6 is a rear view of the interior escutcheon illustrating the lock assembly varied from the unlocked state to a locked state via a first engagement mechanism.
Figure 7:
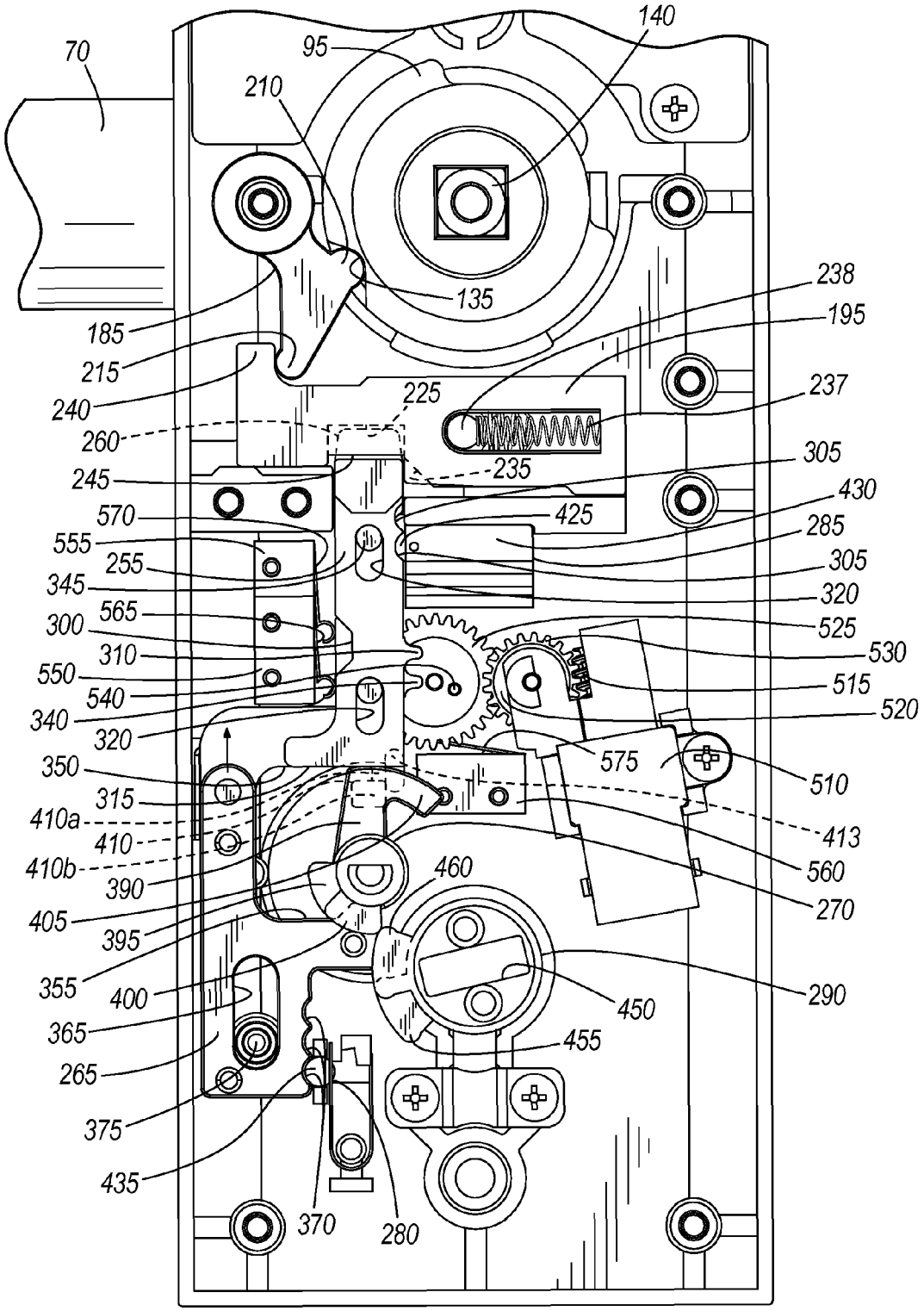
FIG. 7 is a rear view of the interior escutcheon illustrating the lock assembly varied from the locked state to a deadlocked state via the first engagement mechanism.
Figure 8:
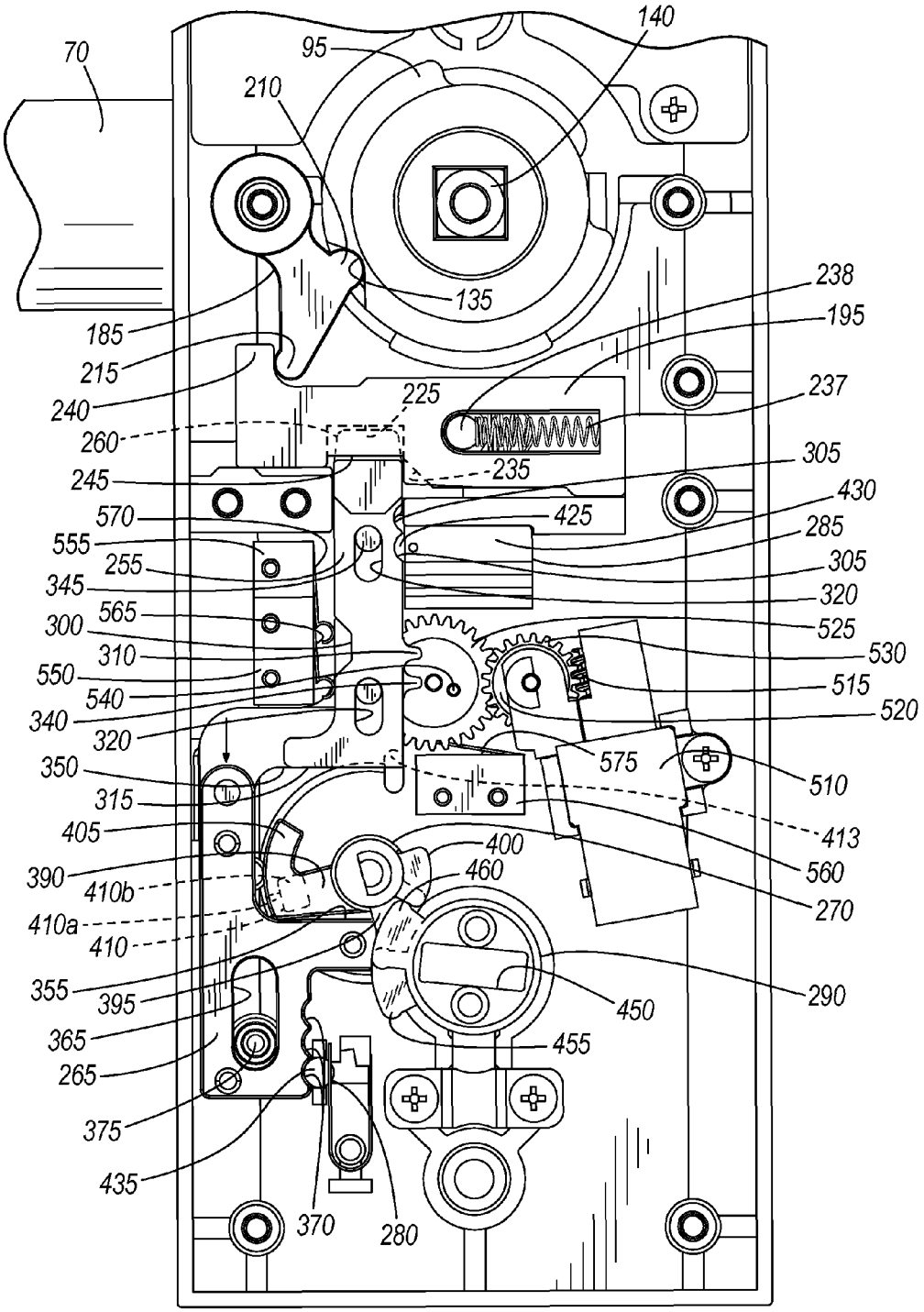
FIG. 8 is a rear view of the interior escutcheon illustrating the lock assembly in the deadlocked state and being varied to the locked state via the first engagement mechanism.

The interior lock bar 260 is movable between a first position (FIGS. 5 and 10), a second position (FIGS. 6 and 9), and a third position (FIGS. 7 and 8). The first position corresponds to the unlocked state in which the interior lock bar 260 is disengaged from the interior slide member 190. The second position corresponds to the locked state in which the interior lock bar 260 is engaged with the interior slide member 190 adjacent the chamfered portion 235. The third position corresponds to the deadlocked state in which the interior lock bar 260 is engaged with the interior slide member 190 within the second slot 245. Generally, the exterior lock bar 255 and the interior lock bar 260 are movable with each other between the respective first and second positions. The interior lock bar 260 is further movable relative to the exterior lock bar 255 between the second position and the third position.

The link 265 is coupled to the interior lock bar 260 adjacent the second end and is movable with the interior lock bar 260 between the first, second, and third positions. As illustrated, the link 265 is a separate component that is pinned to the interior lock bar 260. In some constructions, the link 265 can be formed as part of the interior lock bar 260 such that the interior lock bar 260 and the link 265 form a single component. With regard to the interior lock bar 260 and the link 265, the phrase "coupled to" is intended to mean either that the interior lock bar 260 and the link 265 are separate components that are attached to each other, or that the interior lock bar 260 and the link 265 form a single component.

The link 265 includes a third engagement portion 355 that is spaced apart from the first engagement portion 315 and the second engagement portion 350. In constructions including the interior lock bar 260 and the link 265 formed as a single component, the third engagement portion 355 can be provided on the interior lock bar 260. The link 265 also has a slide channel 365 and a plurality of locator recesses or detents 370 (e.g., three locator detents 370 as illustrated in FIGS. 5-10). A slide pin 375 is coupled to the interior escutcheon 45 and is engaged with the link 265 within the slide channel 365 to facilitate linear movement of the link 265 with the interior lock bar 260.

The interior drive member 270 defines a first engagement mechanism that is rotatably coupled to the interior escutcheon 45 at a location between the exterior and interior lock bars 255, 260 and the link 265. The interior drive member 270 is further located adjacent and selectively engageable with the first engagement portion 315, the second engagement portion 350, and the third engagement portion 355. The interior drive member 270 includes a central portion 380 that is rotatable relative to the interior escutcheon 45 and that has a drive member connector portion 385 that is located adjacent the distal end of the central portion 380.

The interior drive member 270 also includes an engagement member 390, a first cam portion 395, and a second cam portion 400. The engagement member 390 extends radially outward from the central portion 380. With reference to FIGS. 4-10, 15-20, and 23, the engagement member 390 includes a first actuator 405 that extends from the body of the engagement member 390 in a circumferential or rotational direction relative to a longitudinal axis of the interior driver member 270, and a second actuator 410 that extends from the body of the engagement member 390 in an axial direction substantially parallel to the longitudinal axis. In other words, the first actuator 405 extends in a first plane that is perpendicular to the axial direction of the interior drive member 270, and the second actuator 410 extends in a second plane that is perpendicular to the first plane.

The first actuator 405 is engageable with the first engagement portion 315 in response to rotation of the interior drive member 270 in the first direction (clockwise direction as viewed in FIGS. 5-10) a first predetermined amount (e.g., 45 degrees) from the static position. The first actuator 405 also is engageable with the third engagement portion 355 in response to rotation of the interior drive member 270 in a second direction opposite the first direction. The interior drive member 270 is rotatable from the static position approximately 90 degrees in the first direction, and approximately 90 degrees in the second direction to move the exterior lock bar 255 and the interior lock bar 260 between the respective first positions and second positions, and to move the interior lock bar 260 between the second position and the third position.

As illustrated in FIGS. 4-10, 15-20, and 23, the second actuator 410 is defined by a first actuator portion 410*a* and a second actuator portion 410*b* located adjacent the first actuator portion 410*a*. The first actuator portion 410*a* is aligned and engageable with the second engagement portion 350 in response to rotation of the interior drive member 270 in the first direction a second predetermined amount (e.g., 90 degrees) from the static position. The second actuator portion 410*b* is engageable with a stop 413 in response to rotation of the interior drive member 270 in the first direction the second predetermined amount to limit over-rotation of the interior drive member 270. The second actuator portion 410*b* is larger than the first actuator portion 410*a* and can stiffen the first actuator portion 410*a*.

The first cam portion 395 extends radially outward from the central portion 380 and is located inward from the distal end. The second cam portion 400 extends radially outward from the central portion 380 between the engagement member 390 and the first cam portion 395. As illustrated, the second cam portion 400 is formed as part of the first cam portion 395 and is angularly offset approximately 45 degrees from the first cam portion 395.

Figure 5:
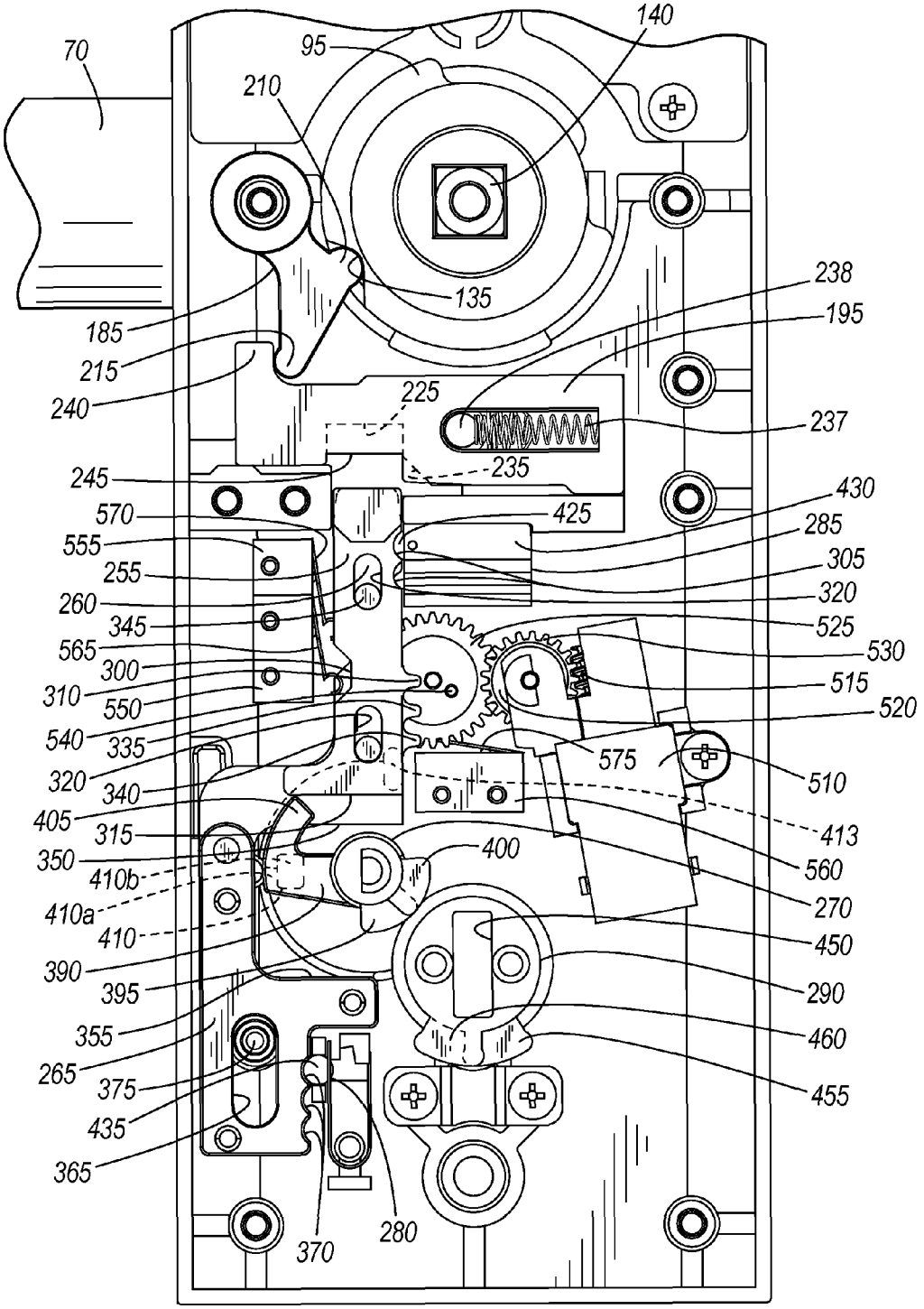
FIG. 5 is a rear view of the interior escutcheon illustrating the lock assembly in an unlocked state.

As illustrated in FIG. 5, the interior drive member 270 is oriented in a static position when the interior drive member 270 is not engaged with the first engagement portion 315, the second engagement portion 350, or the third engagement portion 355. In some constructions, the interior drive member 270 is biased to the static position (e.g., the position of the interior drive member 270 illustrated in FIG. 5) by a spring or other bias member (not shown). In other constructions, the interior drive member 270 can be coupled to the interior escutcheon 40 via friction fit or other suitable connection.

With reference to FIGS. 2 and 3, the exterior drive member 275 is coupled to the exterior escutcheon 40 and is biased (e.g., by a spring) to a static position. The exterior drive member 275 defines a drive member hole 415 and a third cam portion 420 that extends radially outward from a central portion of the exterior drive member 275 adjacent the distal end of the exterior drive member 275. The drive member hole 415 is shaped to receive the drive member connector portion 385 such that rotation of the exterior drive member 275 transfers to the interior drive member 270. As illustrated, the exterior drive member 275 is oriented in a static position. In some constructions, the exterior drive member 275 is biased to the static position by a spring or other bias member (not shown). In other constructions, the exterior drive member 275 can be coupled to the exterior escutcheon 45 via friction fit or other suitable connection.

The exterior drive member 275 is rotatable approximately 45 degrees in the counter-clockwise direction (as viewed in FIG. 3, which corresponds to clockwise direction as viewed from the left in FIG. 1) to rotate the interior drive member 270 approximately 45 degrees in the clockwise direction (as viewed in FIG. 5). The exterior drive member 275 is further rotatable approximately 90 degrees in the clockwise direction (as viewed in FIG. 3, which corresponds to the counter-clockwise direction as viewed from the left in FIG. 1) to rotate the interior drive member 270 approximately 90 degrees in the counter-clockwise direction.

As can be appreciated by one of ordinary skill in the art, counter-clockwise rotation of the exterior drive member 275 as viewed in FIG. 3 corresponds to rotation of the exterior drive member 275 in the first direction (clockwise direction) when the lock assembly 10 is viewed from the left in FIG. 1. Also, clockwise rotation of the exterior drive member 275 as viewed in FIG. 3 corresponds to rotation of the exterior drive member 275 in the second direction (counter-clockwise direction) when the lock assembly 10 is viewed from the left in FIG. 1. Hereafter, the direction of rotation of the exterior drive member 275 and the exterior lock cylinder 295 will be described as if viewed from the left in FIG. 1 so that the direction of rotation for these components will be described consistent with the direction of rotation of the interior drive member 270 and the interior lock cylinder 290.

As shown in FIGS. 4-10 and 15-20, the interior locator 280 and the exterior locator 285 are coupled to the interior escutcheon 45. The interior locator 280 has a first locator member 425 that is biased into engagement with one of the locator detents 370 to hold the interior lock bar 260 and the link 265 in one of the first position, the second position, and the third position. The exterior locator 285 includes a casing 430 and a second locator member 435 that is biased outward from a blind hole (not shown) in the casing 430. The second locator member 435 is biased into engagement with one of the two locator detents 305 to hold the exterior lock bar 255 in either the first position or the second position.

The interior lock cylinder 290 defines a first actuator mechanism that is coupled to and accessible from outside the interior escutcheon 45. As shown in FIGS. 2, 4, and 21-23, the interior lock cylinder 290 includes a first housing 440 and a first plug 445 that defines a first key passageway 450 for receiving a key (e.g., the key 25). The first plug 445 is selectively rotatable within the first housing 440. The first plug 445 has a first cam 455 and a second cam 460 axially offset (e.g., 45 degrees) from the first cam 455. The first cam 455 and the second cam 460 are rotatable together, and the first cam 455 is engageable with the first cam portion 395 and the and the second cam 460 is engageable with the second cam portion 400 in response to rotation of the first plug 445.

FIG. 24 shows another first actuator mechanism or thumbturn 465 that can be used with the lock assembly 10 in place of the interior lock cylinder 290. As illustrated, the thumbturn 465 is coupled to and accessible from outside the interior escutcheon 45. The thumbturn has a body (not shown) that is similar to the first housing 440, and a cam (not shown) that is coupled to the body and that is rotatable in response to rotation of the thumbturn 465. The cam is similar to the first and second cams 455, 460, and is engageable with the first cam portion 395 and the second cam portion 400 in the same manner.

With reference back to FIGS. 1-3, the exterior lock cylinder 295 defines a second actuator mechanism is coupled to and accessible from outside the exterior escutcheon 40, and includes a second housing 470 and a second plug 475 that defines a second key passageway 480 for receiving a key (e.g., the key 25). The second plug 475 is selectively rotatable within the second housing 470, and has a third cam 485 that is rotatable in response to rotation of the second plug 475. In response to rotation of the second plug 475, the third cam 485 is engageable with the third cam portion 420 of the exterior drive member 275 to rotate the third cam portion 420, which transfers to the interior drive member 270.

Figure 14:
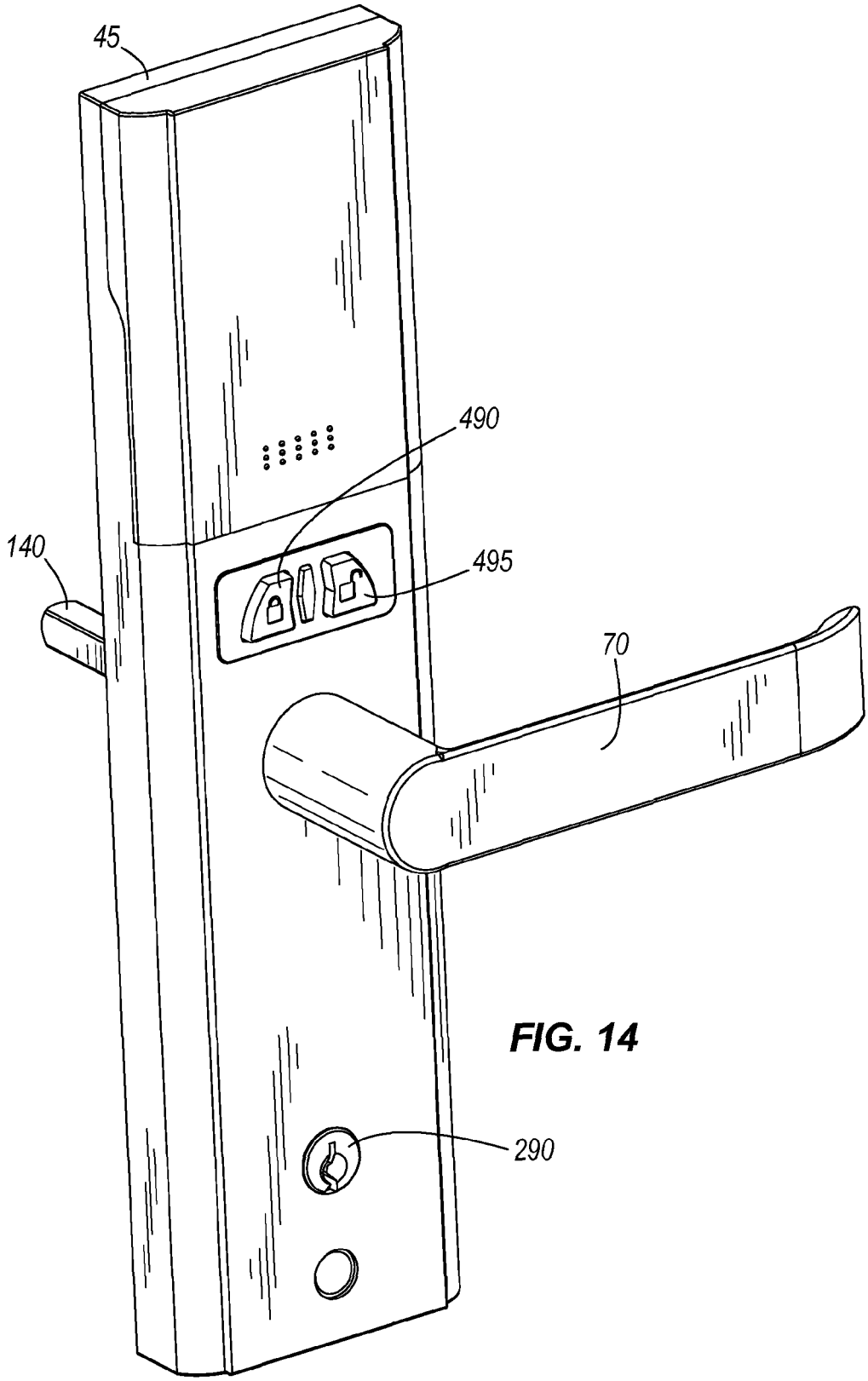
FIG. 14 is a perspective view of the interior escutcheon including a first button and a second button.

With reference to FIGS. 1, 14, and 24, the electronic keypad 20 is coupled to and accessible from outside the exterior escutcheon 40, and the lock assembly 10 further includes a first electronic button 490 and a second electronic button 495 that are coupled to and accessible from outside the interior escutcheon 45. As illustrated, the keypad 20 has a cover 500 for protecting keys 505 on the keypad 20. With reference to FIGS. 1, 5-10, 15-20, 23, and 24, the keypad 20 and the first and second electronic buttons 490, 495 define third actuator mechanisms that are in electric communication with a motor 510 coupled to the interior escutcheon 45. The first electronic button 490 defines a lock button that facilitates varying the lock assembly 10 to the locked state or the deadlocked state via the motor 510. The second electronic button 495 is an unlock button that facilitates varying the lock assembly 10 to the unlocked state via the motor 510. A code can be entered on the keypad 20 to vary the lock assembly 10 between at least two of the unlocked state, the locked state, and the deadlocked state.

Referring to FIGS. 4-10 and 15-20, the lock assembly 10 further includes a first gear 515, a second gear 520, and a third gear 525. The first gear 515 is coupled to a drive shaft (not shown) of the motor 510 for rotation with the drive shaft. The illustrated first gear 515 is a helical gear, although other gears are possible and considered herein. The second gear 520 is attached to the interior escutcheon 45 and is rotatably coupled to the first gear 515 for rotation in response to the first gear 515. As shown in FIGS. 4-10, 15-20 and 23, the second gear 520 includes a driven portion 530 coupled to the first gear 515 and a drive portion 535 that is smaller than the driven portion 530 and that is coupled to the third gear 525.

The third gear 525 is attached to the interior escutcheon 45 and that is rotatably coupled to the second gear 520. With reference to FIGS. 4-10 and 15-20, the third gear 525 includes a drive pin 540 and a cam member 545 that extends from a second side of the third gear 525. The drive pin 540 defines a second engagement mechanism that extends from one side of the third gear 525, and is radially offset from the center of the third gear 525.

The drive pin 540 is engageable with the first tooth 310 of the exterior lock bar 255 in response to a first rotation of the third gear 525 in the first direction to move the interior lock bar 260 and the exterior lock bar 255 from the first position to the second position. The drive pin 540 also is engageable with the second tooth 335 in response to a second rotation of the third gear 525 in the first direction to move the interior lock bar 260 from the second position to the third position and to hold the exterior lock bar 255 in the second position. The drive pin 540 is further engageable with the third tooth 340 in response to a first rotation of the third gear 525 in the second direction to move the interior lock bar 260 from the third position to the second position. The drive pin 540 is engageable with the second tooth 335 in response to a second rotation of the third gear 525 in the second direction to move the interior lock bar 260 and the exterior lock bar 255 from the respective second positions to the corresponding first positions.

As shown in FIGS. 4-10, 15-20, and 23, the lock assembly 10 also includes a first sensor 550, a second sensor 555, and a third sensor 560 to detect parameters of the lock assembly 10. The first sensor 550 includes a first sensor arm 565 that is in communication with the exterior lock bar 255 within the first sensor recess 300. The second sensor 555 includes a second sensor arm 570 that is in communication with the interior lock bar 260 within the second sensor recess 325.

The first sensor 550 and the second sensor 555 cooperate to detect the state of the lock assembly 10 (e.g., unlocked state, locked state, deadlocked state) based on whether one or both of the first and second sensors 550, 555 are active. The first sensor 550 is inactive when the first sensor arm 565 is disposed in the first sensor recess 300 without being depressed or pressed upon by the exterior lock bar 255 (e.g., when the exterior lock bar 255 is in the first position). The first sensor 550 is active when the first sensor arm 565 is depressed or otherwise pressed or acted upon by the exterior lock bar 255 (e.g., when the exterior lock bar 255 is in the second position). The second sensor 555 is inactive when the second sensor arm 570 is disposed in the second sensor recess 325 without being depressed or pressed upon by the interior lock bar 260 (e.g., when the interior lock bar 260 is in the first position or the second position). The second sensor 555 is active when the second sensor arm 570 is depressed or otherwise pressed or acted upon by the interior lock bar 260 (e.g., when the interior lock bar 260 is in the third position).

The third sensor 560 includes a third sensor arm 575 that is in communication with the cam member 545 of the third gear 525. When the third sensor 560 is active, the third sensor arm 575 interacts with the cam member 545 to determine when rotation of the third gear 525 should be stopped via the motor 510 to achieve a desired orientation or position of the drive pin 540. The third sensor 560 is active when the oblong or elongated portion of the cam member 545 is engaged with or depresses the third sensor arm 575. The third sensor 560 is inactive when the third sensor arm 575 is not acted upon by the cam member 545. Generally, the first, second, and third sensors 550, 555, 560 are in communication with a controller to deliver or transmit signals indicative of parameters of the lock assembly 10 based on whether the respective sensors 550, 555, 560 are active or inactive.

Figure 26:
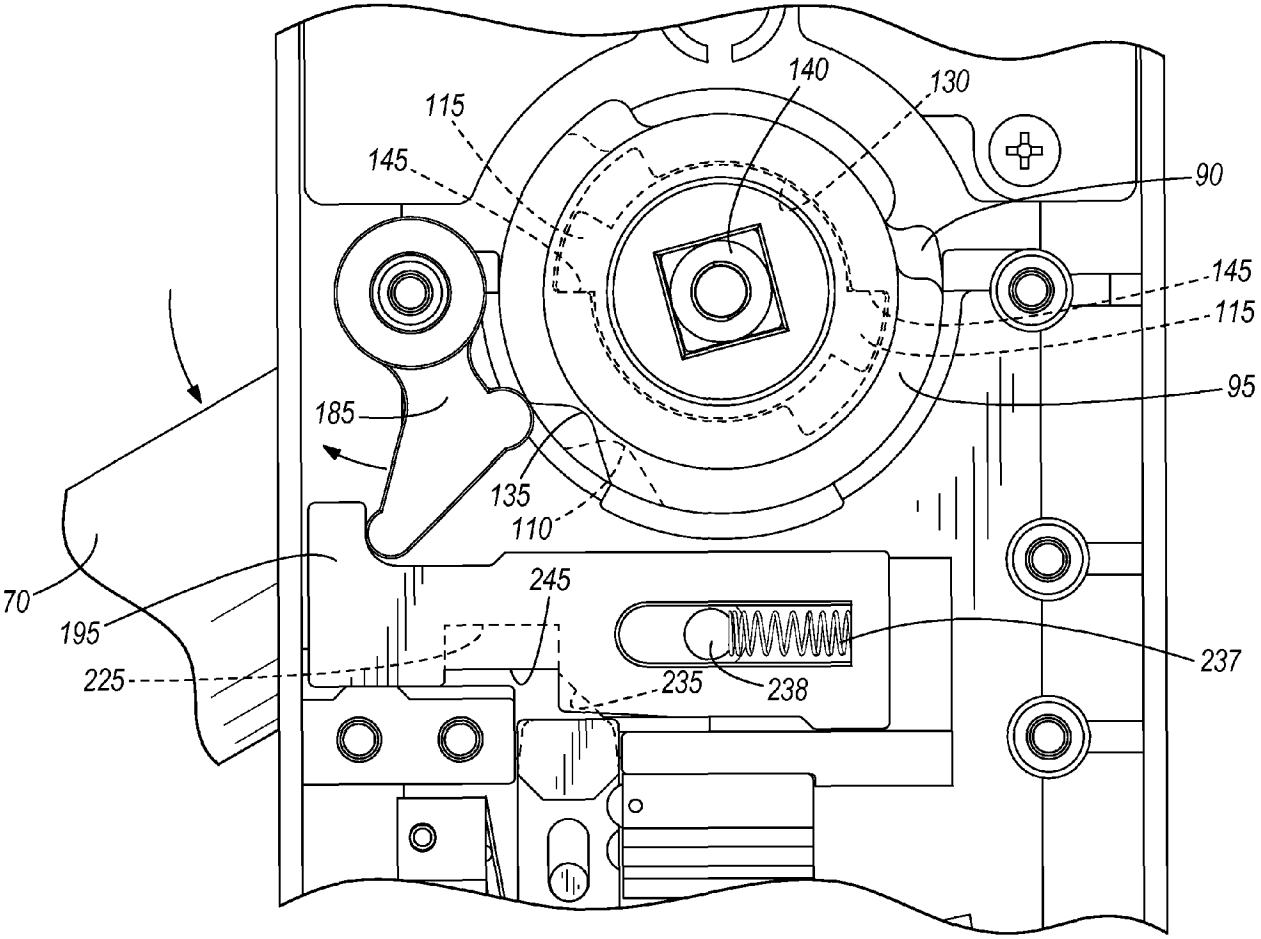
FIG. 26 is another rear view of a portion of the interior escutcheon illustrating operation of the lock assembly in response to rotation of the interior handle.
Figure 27:
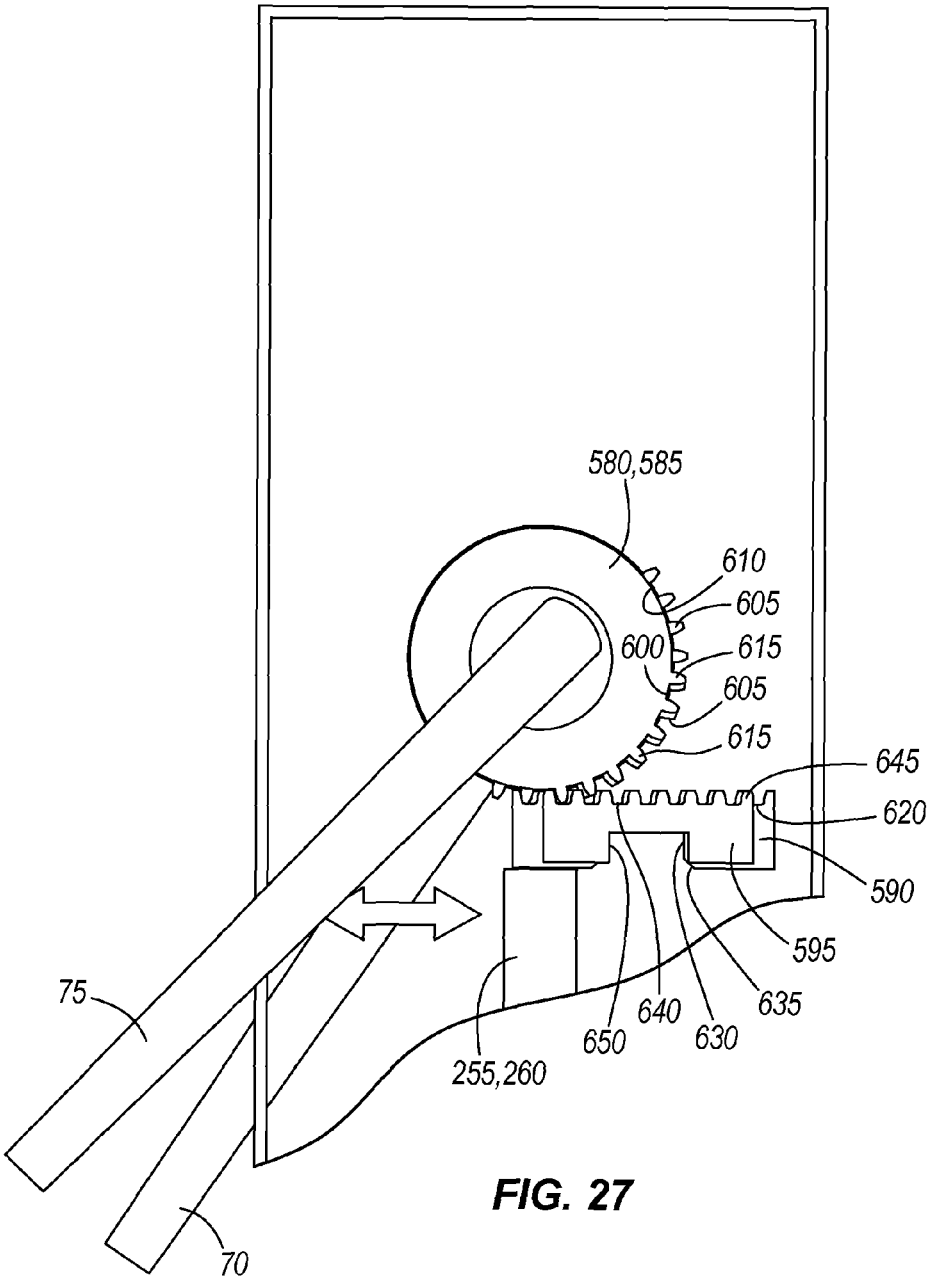
FIG. 27 is a rear view of another interior escutcheon illustrating the lock assembly in an unlocked state.
Figure 28:
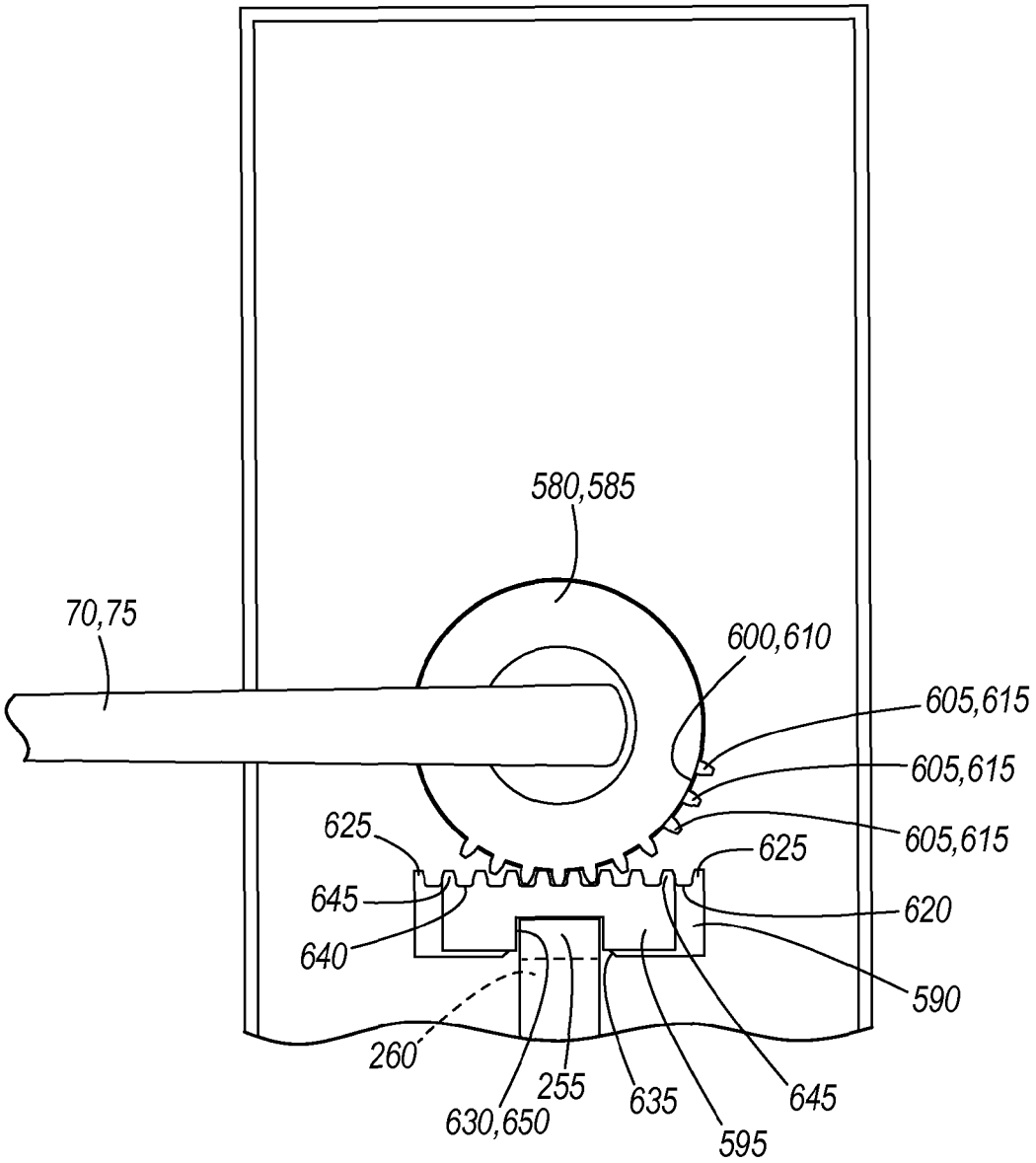
FIG. 28 is another rear view of the interior escutcheon of FIG. 27 illustrating the lock assembly in a locked state.
Figure 29:
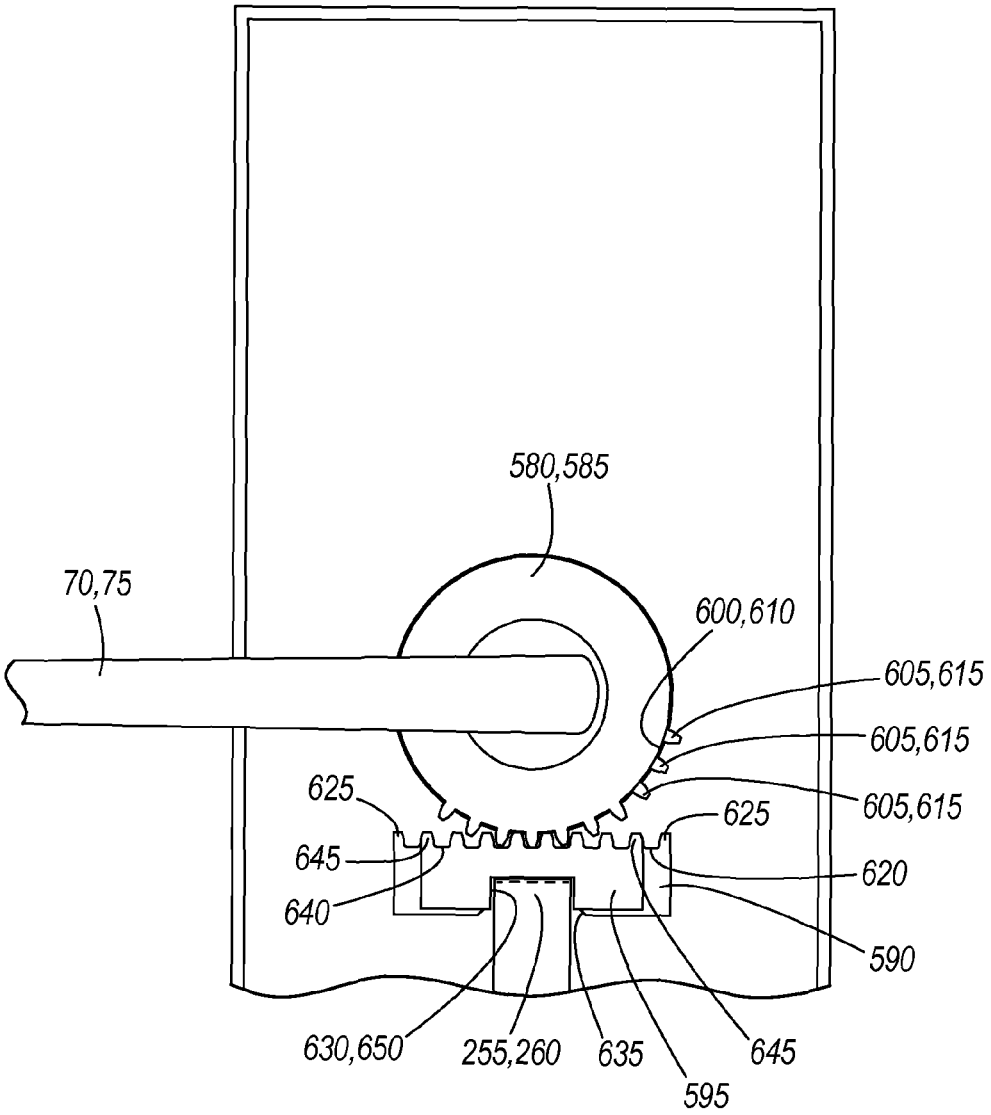
FIG. 29 is another rear view of the interior escutcheon of FIG. 27 illustrating the lock assembly in a deadlocked state.

FIGS. 27-29 illustrate another interior hub 580, exterior hub 585, interior slide member 590, and exterior slide member 595 for use with the lock assembly 10. Except as described below, the interior hub 580, the exterior hub 585, the interior slide member 590, and the exterior slide member 595 are the same as the corresponding interior hub 90, the exterior hub 95, the interior slide member 190, and the exterior slide member 195 described with regard to FIGS. 1-26.

As shown in FIGS. 27-29, the interior hub 580 is defined by a first gear or pinion mechanism 600 that has a plurality of teeth 625 disposed along circumferential periphery of the interior hub 580. The exterior hub 585 is defined by a second gear or pinion mechanism 610 that has a plurality of teeth 615 disposed along a circumferential periphery of the exterior hub 585.

The interior slide member 590 is defined by a first rack mechanism 620 that has a plurality of teeth 625 engaged by the plurality teeth 625 of the interior hub 580, and the interior slide member 590 includes a first slot 630 and a chamfered portion 635 adjacent the first slot 630. The first pinion mechanism 600 and the first rack mechanism 620 cooperate to define a blocking member for the interior hub 580. The interior slide member 590 is movable (left or right as viewed in FIGS. 27-29) in response to rotation of the interior hub 580 due to engagement of the first pinion mechanism 600 with the first rack mechanism 620.

The exterior slide member 595 is defined by a second rack mechanism 640 that has a plurality of teeth 645 engaged by the teeth 615 of the exterior hub 585. The second pinion mechanism 610 and the second rack mechanism 640 cooperate to define a blocking member for the exterior hub 585. The exterior slide member 595 includes a second slot 650 that is aligned with the first slot 630 when the interior handle 70 and the exterior handle 75 are in the inactive state. The exterior slide member 595 is movable (left or right as viewed in FIGS. 27-29) in response to rotation of the exterior hub 585 due to engagement of the second pinion mechanism 610 with the second rack mechanism 640.

The interior lock bar 260 is engageable with the interior slide member 590 within the first slot 630, and the exterior lock bar 255 is engageable with the exterior slide member 595 within the second slot 650. As illustrated in FIG. 27, the first end of the interior lock bar 260 is disengaged from the interior slide member 590 and the first end of the exterior lock bar 255 is disengaged from the exterior slide member 595 when the lock assembly 10 is in the unlocked state. As a result, the interior slide member 590 is movable in response to rotation of the interior hub 580 via the interior handle 70. Similarly, the exterior slide member 595 is movable in response to rotation of the exterior hub 585 via the exterior handle 75 when the lock assembly 10 is in the unlocked state.

As illustrated in FIG. 28, the first end of the interior lock bar 260 is located adjacent chamfered portion 635 and the exterior lock bar 255 is engaged with the exterior slide member 595 within the second slot 650 when the lock assembly 10 is in the locked state. As a result, the exterior slide member 595 is substantially immovable due to engagement of the exterior lock bar 255 with the second slot 650, and the interior slide member 590 is movable in response to rotation of the interior hub 580 via the interior handle 70.

As illustrated in FIG. 29, the first end of the interior lock bar 260 is engaged with the interior slide member 590 within the first slot 630 and the exterior lock bar 255 is engaged with the exterior slide member 595 within the second slot 650 when the lock assembly 10 is in the deadlocked state. As a result, the interior slide member 590 and the exterior slide member 595 are substantially immovable except for "play" provided by the initial lost rotative motion between the interior hub 580 and the exterior hub 585.

In operation, the lock assembly 10 can be varied between at least two of the unlocked state, the locked state, and the deadlocked state via operation of one or more of the first actuator mechanism (e.g., the interior lock cylinder 290 or the thumbturn 465), the second actuator mechanism (e.g., the exterior lock cylinder 295), and the third actuator mechanisms (e.g., the keypad 20 or the first and second buttons 490, 495. The actuator mechanism chosen to vary the lock assembly 10 between states depends in part on whether egress or ingress is desired through the door 15, and the current state of the lock assembly 10.

When the lock assembly 10 is in the unlocked state, the exterior lock bar 255 is disengaged from the second slot 245 and the interior lock bar 260 is disengaged from the first slot 225. Also, the pins 345 are disposed at a bottom location of the pin channels 320 (as viewed in FIGS. 5 and 15). As a result, the latch 55 can be varied between the extended position and the retracted position when at least one of the interior handle 70 and the exterior handle 75 is moved. Rotation of the interior handle 70 rotates the interior hub 90, which in turn pivots the interior ram member 180 via the first circumferential recess 110 and the ramped surfaces 120 acting on the first portion 200 of the interior ram member 180. In response to pivotal movement of the interior ram member 180 out of the first circumferential recess 110, the second portion 205 pushes the first tab 220, which slides the interior slide member 190 (to the left in FIGS. 5-10 and 15-20) and allows further rotation of the interior hub 90 so that the latch can be retracted. The latch 55 returns to the extended position upon release of the interior handle 70 (i.e., after the interior handle 70 returns to the inactive state). In particular, the bias of the interior slide member 190 cooperates with rotation of the interior handle 70 to re-align the first portion 200 of the interior ram member 180 with the first circumferential recess 110, and the latch 55 returns to the extended position.

Rotation of the exterior handle 75 when the lock assembly 10 is in the unlocked state rotates the exterior hub 95, which in turn pivots the exterior ram member 185 via the second circumferential recess 135 and the ramped surfaces 160 acting on the first portion 210 of the exterior ram member 185. In response to pivotal movement of the interior ram member 180 out of the second circumferential recess 135, the second portion 215 pushes the second tab 240, which slides the interior slide member 190 (to the left in FIGS. 5-10 and 15-20) and allows further rotation of the exterior hub 95 so that the latch can be retracted. The latch 55 returns to the extended position upon release of the exterior handle 75 (i.e., after the exterior handle 75 returns to the inactive state). In particular, the bias of the exterior slide member 195 cooperates with rotation of the interior handle 70 to re-align the first portion 210 of the exterior ram member 185 with the second circumferential recess 135, and the latch 55 returns to the extended position.

As shown in FIGS. 5, 6, 15, and 16, the lock assembly 10 can be varied from the unlocked state to the locked state using an appropriate key (e.g., the key 25) inserted into the interior lock cylinder 290 or the exterior lock cylinder 295, using the keypad 20, or using the first electronic button 490. With reference to FIGS. 5 and 6, upon rotation of the first plug 445 in the counter-clockwise or second direction (e.g., greater than 180 degrees) when the lock assembly 10 is in the unlocked state, the first cam portion 395 is engaged by the first cam 455 to rotate the interior drive member 270 approximately 45 degrees in the clockwise direction (the first direction). The first actuator 405 and the second actuator 410 rotate with the interior drive member 270, but only the first actuator 405 is engaged with the first engagement portion 315 to push the exterior lock bar 255 from the first position to the second position to engage the exterior lock bar 255 in the second slot 245 of the exterior slide member 195. The second locator member 435 is displaced from one locator detent 305 to the other locator detent 305 to hold the exterior lock bar 255 in the second position.

Due to the relationship of the pin channels 320 and the pins 345, the interior lock bar 260 moves with the exterior lock bar 255 such that the interior lock bar 260 is engaged with the interior slide member 190 adjacent the chamfered portion 235. The link 265 also moves with the interior lock bar 260 from the first position to the second position, and the first locator member 425 is displaced from one of the locator detents 370 (the uppermost detent 370 shown in FIG. 5) to another locator detent 370 (the middle detent 370 shown in FIG. 6) to hold the interior lock bar 260 in the second position.

The lock assembly 10 also can be varied from the unlocked state to the locked state via an appropriate key that is inserted into the exterior lock cylinder 295. Specifically, upon rotation of the second plug 475 in the counter-clockwise direction (e.g., greater than 180 degrees) when the lock assembly 10 is in the unlocked state, the third cam portion 420 is engaged by the third cam 485 to rotate the exterior drive member 275 clockwise approximately 45 degrees. Rotation of the exterior drive member 275 transfers to the interior drive member 270, which in turn acts on the exterior lock bar 255 as described above.

Figure 15:
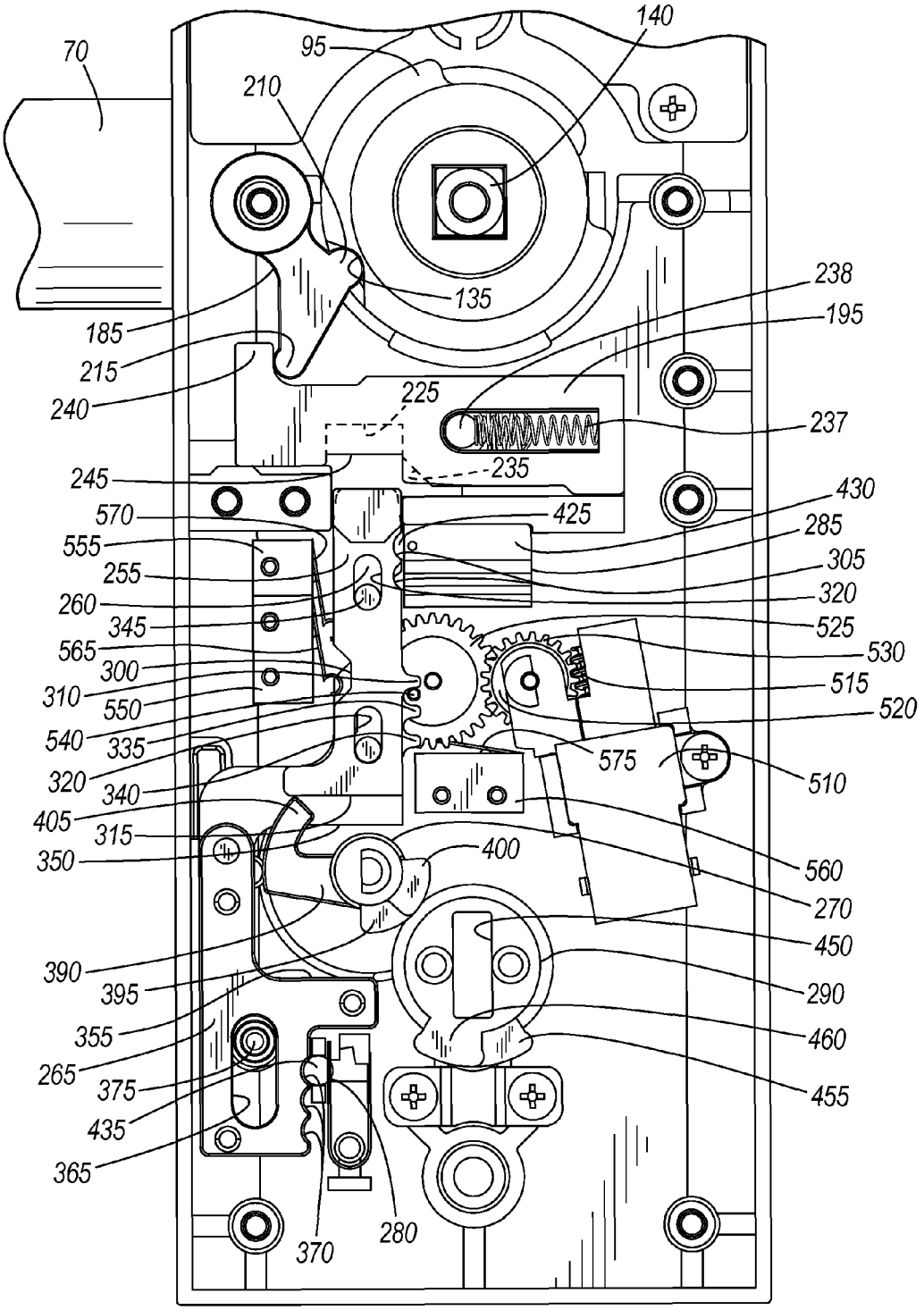
FIG. 15 is another rear view of the interior escutcheon illustrating the lock assembly being varied from the unlocked state to the locked state via a second engagement mechanism.
Figure 16:
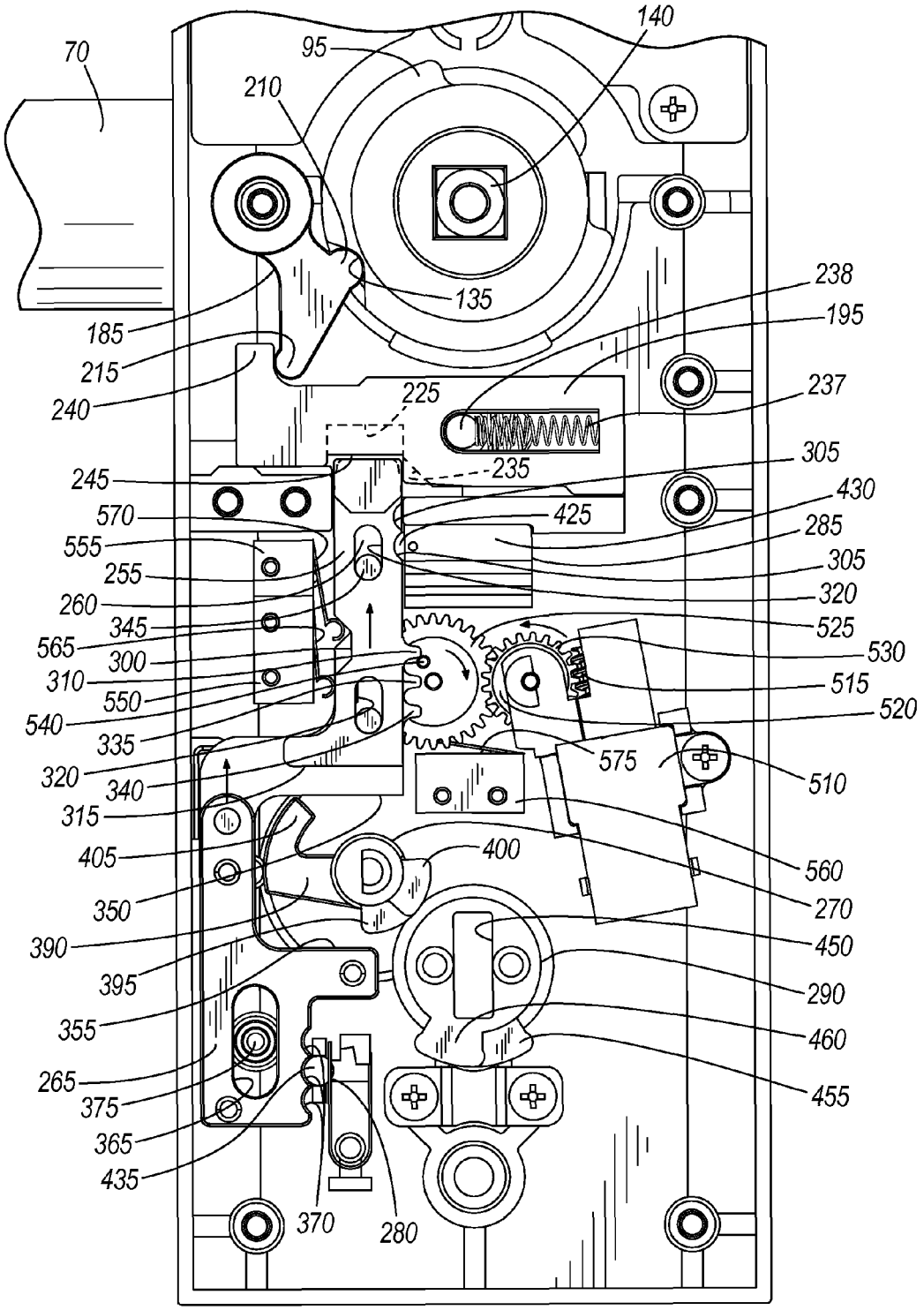
FIG. 16 is another rear view of the interior escutcheon illustrating the lock assembly varied to the locked state via the second engagement mechanism.
Figure 17:
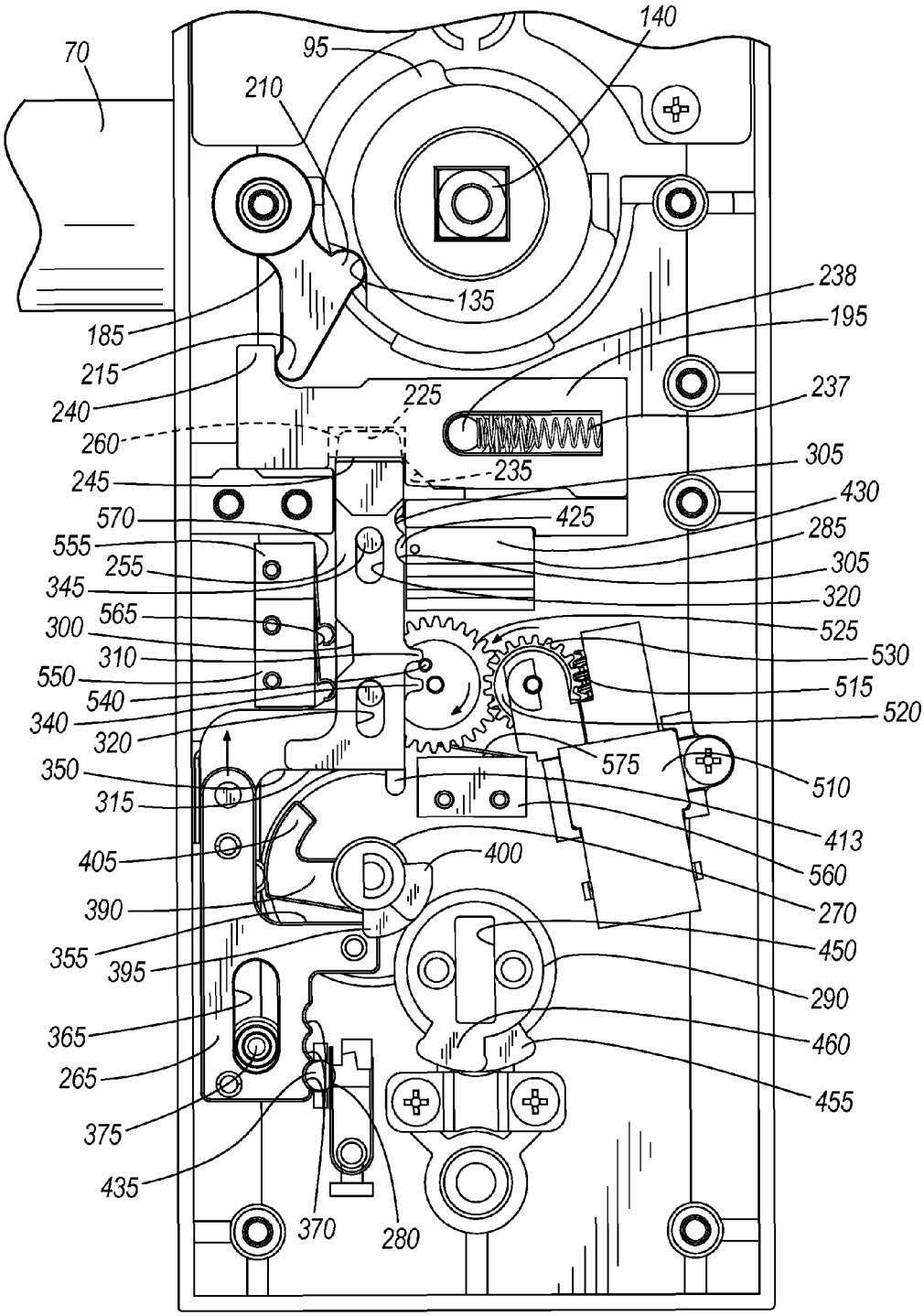
FIG. 17 is another rear view of the interior escutcheon illustrating the lock assembly varied to the deadlocked state via the second engagement mechanism.

Alternatively, the lock assembly 10 can be varied from the unlocked state to the locked state using the keypad 20 or the first electronic button 490. With reference to FIGS. 1, 15, and 16, upon activation of the keypad 20 using an appropriate code or the first electronic button 490, the motor 510 rotates the first gear 515. Rotation of the first gear 515 is transferred to the third gear 525 via the second gear 520. The drive pin 540 rotates with the third gear 525 in the clockwise direction such that the drive pin 540 engages the first tooth 310 to move the exterior lock bar 255 and the interior lock bar 260 from the respective first positions to the corresponding second positions.

In constructions of the lock assembly 10 including the thumbturn 465, the thumbturn 465 can be rotated (e.g., the same amount as the first plug 455) to vary the lock assembly 10 from the unlocked state to the locked state. The cam of the thumbturn 465 rotates in response to rotation of the thumbturn 465 as the first and second cams 455, 460 rotate in response to rotation of the first plug 445. As such, the cam of the thumbturn 465 acts on the interior drive member 270 in the same manner as described with regard to the first and second cam 455, 460.

With reference to FIGS. 5, 15, 25, and 26, the exterior handle 75 is inoperable to gain access through the door 15 when the lock assembly 10 is in the locked state. The exterior slide member 195 is substantially immovable due to engagement of the exterior lock bar 255 with the exterior slide member 195 within the second slot 245. Because the exterior slide member 195 is substantially immovable, the exterior hub 95 is substantially immovable and the exterior handle 75 can only rotate, at most, the angular distance D1 corresponding to the initial lost rotative motion between the interior hub 90 and the exterior hub 95. The angular distance D1 merely provides some "play" or slight movement of the exterior handle 75 and does not disengage the exterior lock bar 255 from the exterior slide member 195. As a result, the exterior handle 75 cannot be used to vary the latch 55 from the extended position to the retracted position when the lock assembly 10 is in the locked state.

Figure 25:
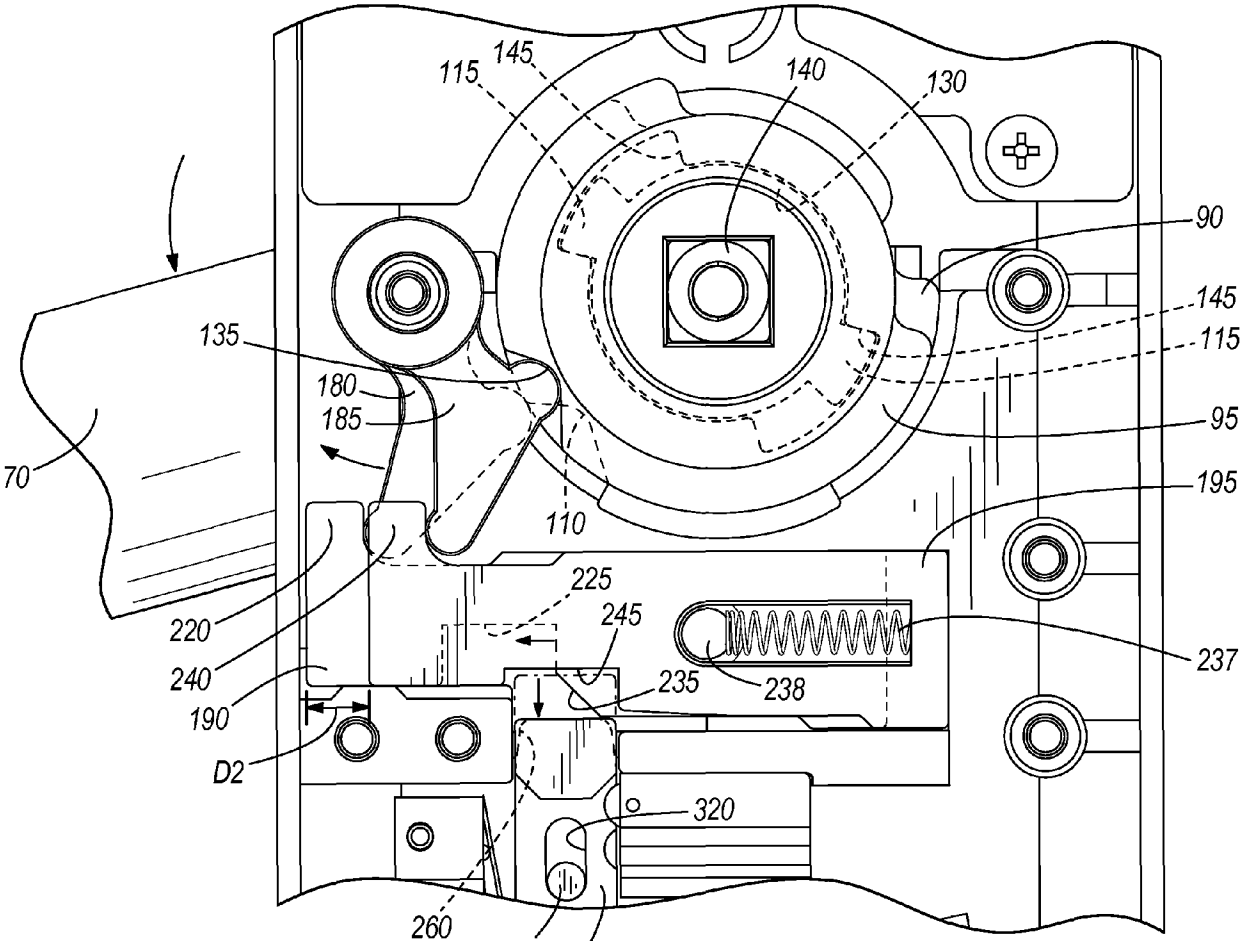
FIG. 25 is a rear view of a portion of the interior escutcheon illustrating operation of the lock assembly in the locked state in response to rotation of the interior handle.

With reference to FIGS. 25 and 26, the interior handle 70 can be rotated to vary the latch 55 from the extended position to the retracted position to gain access through the door 15 when the lock assembly 10 is in the locked state. In particular, rotation of the interior handle 70 rotates the interior hub 90, which acts on the interior ram member 180 to displace the interior ram member 180 from the first circumferential recess 110. In turn, the interior ram member 180 pushes the interior slide member 190. Due to the initial lost rotative motion between the interior hub 90 and the exterior hub 95, the interior hub 90 rotates the angular distance D1 without causing rotation of the exterior hub 95. Rotation of the interior hub 90 and the resulting movement induced on the interior ram member 180 begins to slide the interior slide member 190 relative to the exterior slide member 195. In response to movement of the interior slide member 190 a distance D2 (FIG. 25) corresponding to the angular distance D1, the chamfered portion 235 engages the first end of the interior lock bar 260 and displaces or disengages the interior lock bar 260 from the first slot 225. Disengaging the interior lock bar 260 from the interior slide member 190 displaces or disengages the exterior lock bar 255 from the exterior slide member 195 due to the cooperative movement provided by the relationship between the pin channels 320 and the pins 345.

As illustrated in FIG. 26, after the exterior lock bar 260 is disengaged from the second slot 245 and the interior lock bar 260 is displaced from the first slot 225, the interior handle 70 can be further rotated to retract the latch 55. Specifically, further rotation of the interior handle 70 is permitted because the exterior lock bar 260 is no longer engaged with the exterior slide member 195. With the exterior lock bar 260 disengaged from the exterior slide member 195, further rotation of the interior handle 70 rotates the exterior hub 95 due to engagement of the projection portions 115 with the engagement surfaces 145. In response to rotation of the exterior hub 95, the exterior ram member 185 disengages from the second circumferential recess 135 and the exterior slide member 195 is moved the distance D2. With continued rotation of the interior handle 70, the latch 55 is retracted. In this manner, access through the door 15 when the lock assembly 10 is in the locked state can be provided in response to activation of the interior handle 70, but not in response to activation of the exterior handle 75.

As shown in FIGS. 6, 7, 16, and 17, the lock assembly 10 can be varied from the locked state to the deadlocked state using the interior lock cylinder 290, using the keypad 20, or using the first electronic button 490. With reference to FIGS. 6 and 7, rotation of the first plug 445 in the counter-clockwise or second direction (e.g., greater than 240 degrees) when the lock assembly 10 is in the locked state engages the second cam 460 with the second cam portion 400 to rotate the interior drive member 270 approximately another 45 degrees clockwise (the first direction). As illustrated, the first and second actuators 405, 410 rotate with the interior drive member 270, but the second actuator 410, and in particular the first actuator portion 410*a*, engages the second engagement portion 350 and pushes the interior lock bar 260 relative to the exterior lock bar 255 due to the sliding relationship of the pins 345 within the pin channels 320. The first actuator 405 does not act on the second engagement portion 350, and the second actuator portion 410*b* engages the stop 413 to limit further rotation of the interior drive member 270.

In this manner, the interior lock bar 260 is moved from the second position to the third position such that first end of the interior lock bar 260 is engaged with the interior slide member 190 within the first slot 225. The exterior lock bar 255 remains in the second position. The link 265 moves with the interior lock bar 260 from the second position to the third position, and the first locator member 425 is displaced from the second locator detent 370 to the third locator detent 370 (the lowest locator detent 370 as viewed in FIG. 7) to hold the interior lock bar 260 in the third position. The second locator member 435 remains engaged with the second locator detent 305 in the exterior lock bar 255.

With reference to FIGS. 12 and 13, upon activation of the keypad 20 using an appropriate code or the first electronic button 490, the motor 510 rotates the first gear 515. Rotation of the first gear 515 is transferred to the third gear 525 via the second gear 520. The drive pin 540 rotates with the third gear 525 in the clockwise direction such that the drive pin 540 engages the second tooth 335 to move the interior lock bar 260 relative to the exterior lock bar 255 from the second position to the third position.

In some constructions of the lock assembly 10, the thumbturn 465 can be used to vary the lock assembly 10 to the deadlocked state. In particular, the thumbturn 465 can be rotated a second amount (e.g., another rotation) to re-engage the cam with the interior drive member 270 to vary the interior lock bar 260 to the third position. Alternatively, the cam of the thumbturn can include two cam portions similar to the cams 455, 460 on the interior lock cylinder 290 that act on the interior drive member 270 in a similar manner.

As illustrated, the lock assembly 10 cannot be varied from the locked state to the deadlocked state using the exterior lock cylinder 295 due to the orientation of the third cam portion 420 relative to the third cam 485 on the exterior lock cylinder 295. In some constructions, the exterior lock cylinder 295 can include another cam that can be used to vary the lock assembly 10 to the deadlocked state.

When the lock assembly 10 is in the deadlocked state, the exterior handle 75 and the interior handle 70 are inoperable to gain access through the door 15. Specifically, the exterior slide member 195 is substantially immovable due to engagement of the first end of the exterior lock bar 255 with the exterior slide member 195 within the second slot 245. Similarly, the interior slide member 190 is substantially immovable due to engagement of the first end of the interior lock bar 260 with the interior slide member 190 within the first slot 225. Because the interior slide member 190 and the exterior slide member 195 are substantially immovable, the interior hub 90 and the exterior hub 95 are substantially immovable and the interior and exterior handles 70, 75 can only rotate, at most, the distance D1 corresponding to the lost rotative motion between the interior hub 90 and the exterior hub 95. The "play" provided by the angular distance D1 does not displace or disengage the exterior lock bar 255 from the exterior slide member 195, and does not disengage the interior lock bar 260 from the interior slide member 190. As a result, the interior handle 70 and the exterior handle 75 cannot be rotated to vary the latch 55 from the extended position to the retracted position when the lock assembly 10 is in the deadlocked state. Instead, the latch 55 remains in the extended position when the lock assembly 10 is in the deadlocked state regardless of whether the interior handle 70 or the exterior handle 75 is rotated.

Figure 9:
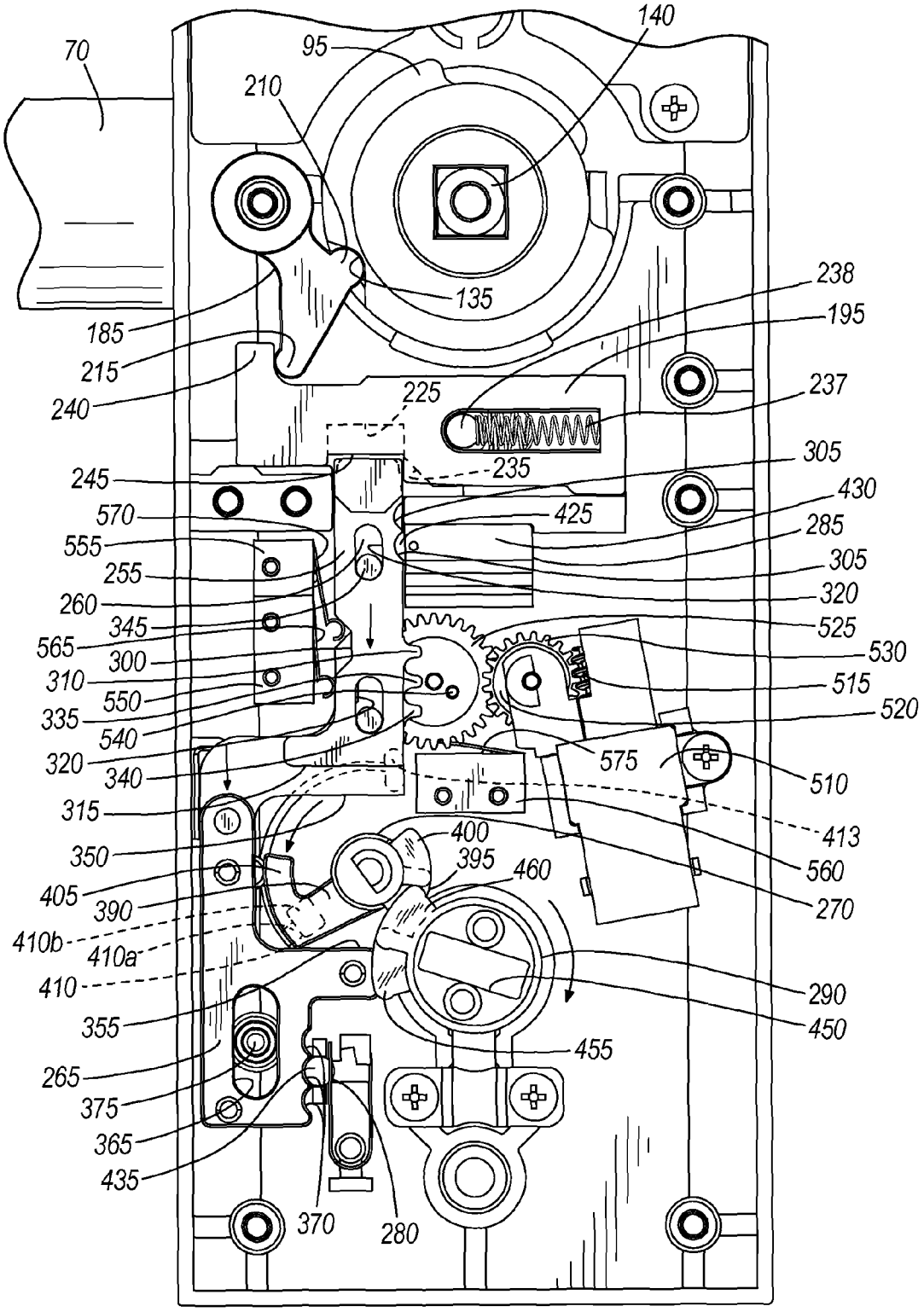
FIG. 9 is a rear view of the interior escutcheon illustrating the lock assembly in the locked state and being varied to the unlocked state via the first engagement mechanism.

As shown in FIGS. 8, 9, 18, and 19, the lock assembly 10 can be varied from the deadlocked state to the locked state using the interior lock cylinder 290, the keypad 20, or the second electronic button 495. With reference to FIGS. 8 and 9, upon rotation of the first plug 445 in the clockwise direction (e.g., approximately 90 degrees) when the lock assembly 10 is in the deadlocked state, the second cam portion 400 is engaged by the second cam 460 to rotate the interior drive member 270 approximately 45 degrees in the counter-clockwise direction. Rotation of the interior drive member 270 in the counter-clockwise direction this amount engages the first actuator 405 with the third engagement portion 355 to move the interior lock bar 260 and the link 265 from the third position to the second position to vary the lock assembly 10 from the deadlocked state to the locked state. The first locator member 425 is displaced from the lowermost locator detent 370 (as viewed in FIGS. 8 and 9) to the middle locator detent 370 (as viewed in FIGS. 8 and 9) to hold the interior lock bar 260 in the second position. The exterior lock bar 255 does not move when the interior lock bar 260 moves from the third position to the second position due to the relative movement provided by the pin channels 320 and the pins 345.

Figure 18:
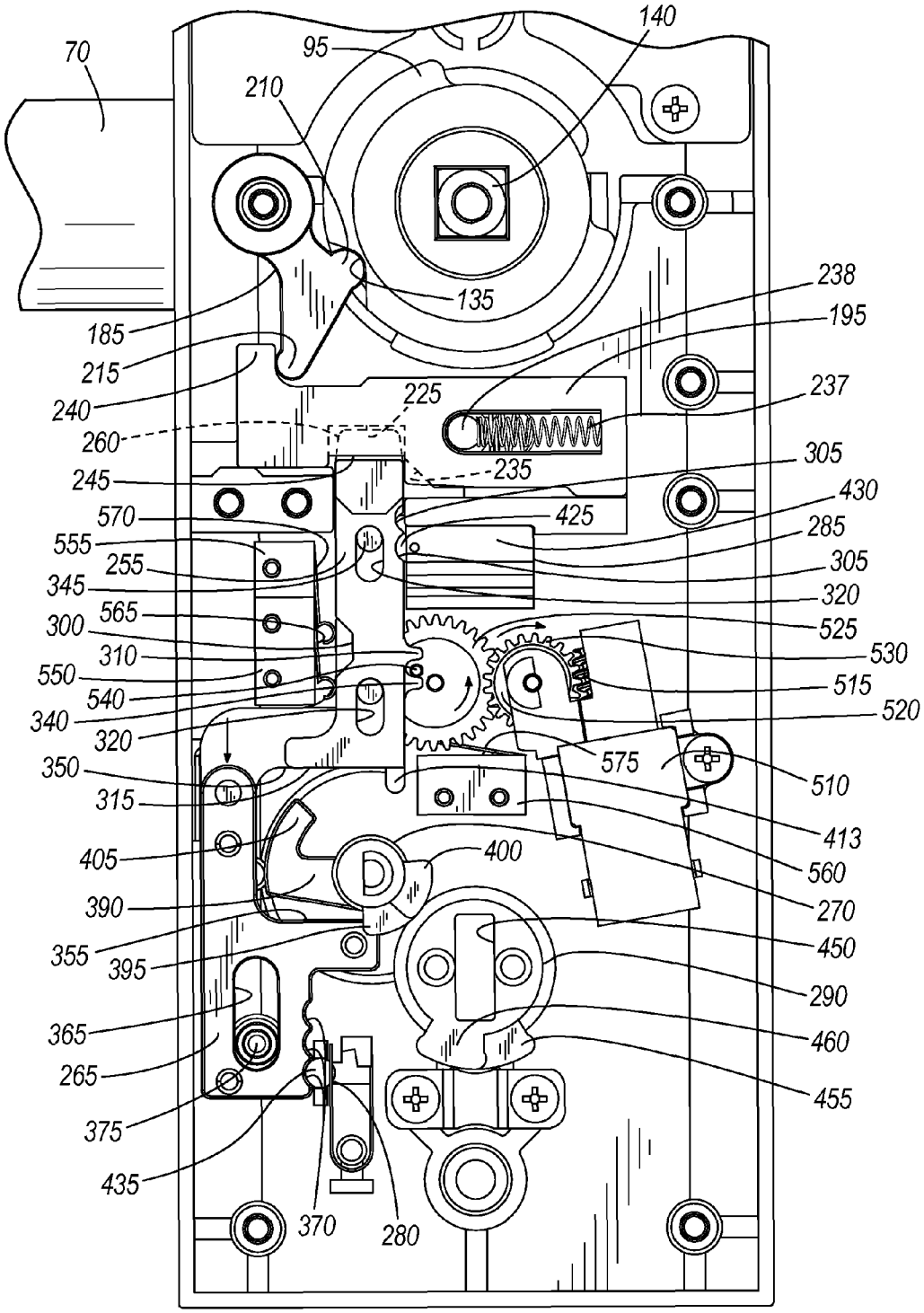
FIG. 18 is another rear view of the interior escutcheon illustrating the lock assembly being varied from the deadlocked state to the locked state via the second engagement mechanism.
Figure 19:
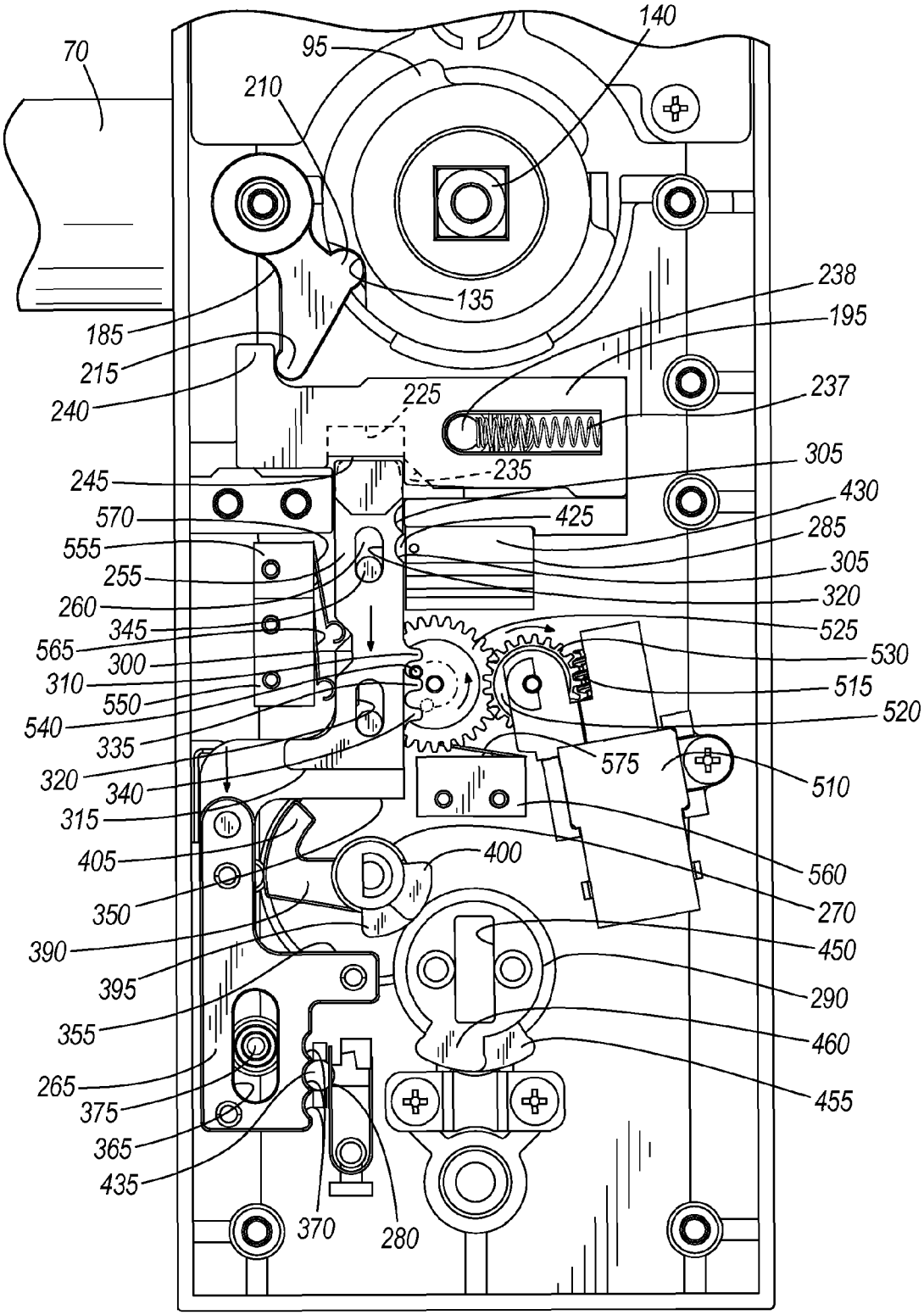
FIG. 19 is another rear view of the interior escutcheon illustrating the lock assembly being varied from the locked state to the unlocked state via the second engagement mechanism.

With reference to FIGS. 18 and 19, upon activation of the keypad 20 using an appropriate code or the second electronic button 495, the motor 510 rotates the first gear 515 in a direction opposite the direction used to vary the lock assembly 10 from the unlocked state to the locked and deadlocked states. Rotation of the first gear 515 transfers to the third gear 525 via the second gear 520. The drive pin 540 rotates with the third gear 525 in the counter-clockwise direction such that the drive pin 540 engages the third tooth 340 to move the interior lock bar 260 relative to the exterior lock bar 255 from the third position to the second position. The first locator member 425 is displaced from the lowermost locator detent 370 (as viewed in FIGS. 18 and 19) to the middle locator detent 370 (as viewed in FIGS. 18 and 19) to hold the interior lock bar 260 in the second position. The exterior lock bar 255 does not move when the interior lock bar 260 moves from the third position to the second position due to the relative movement provided by the pin channels 320 and the pins 345.

In some constructions, the thumbturn 465 can be used to vary the lock assembly 10 from the deadlocked state to the locked state. Generally, rotation of the thumbturn 465 rotates the cam, which in turn engages the interior drive member 270. The interior drive member 270 rotates in the second direction such that the first actuator 405 is engaged with the third engagement portion 355. Rotation of the interior drive member 270 in the second direction moves the link 265 downward (as viewed in FIG. 8), and the interior drive member 270 moves with the link 265 from the third position to the second position in the same manner as described above with regard to use of the interior lock cylinder 290 to vary the lock assembly from the deadlocked state to the locked state.

Figure 10:
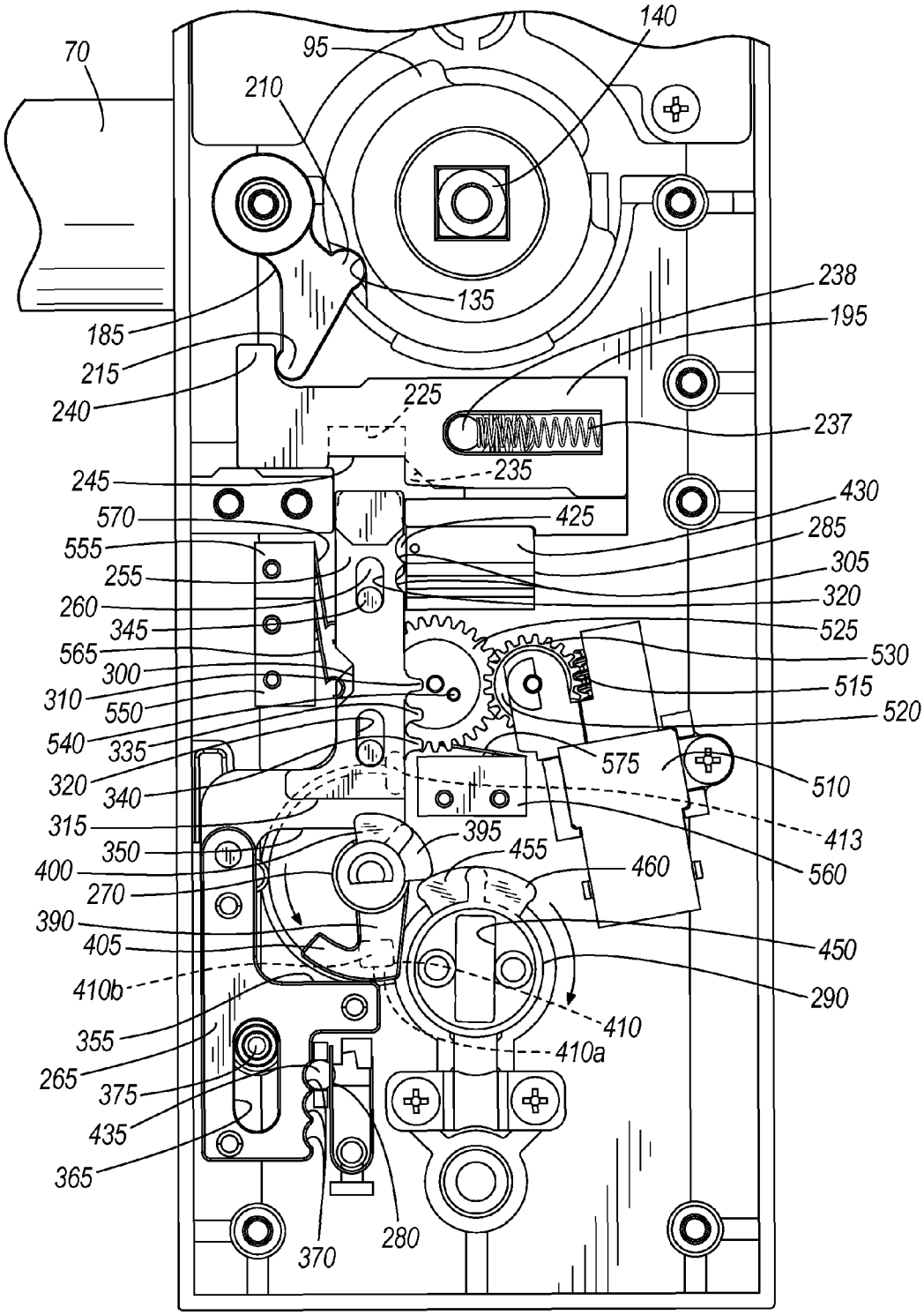
FIG. 10 is a rear view of the interior escutcheon illustrating the lock assembly varied to the unlocked state via the first engagement mechanism.
Figure 11:
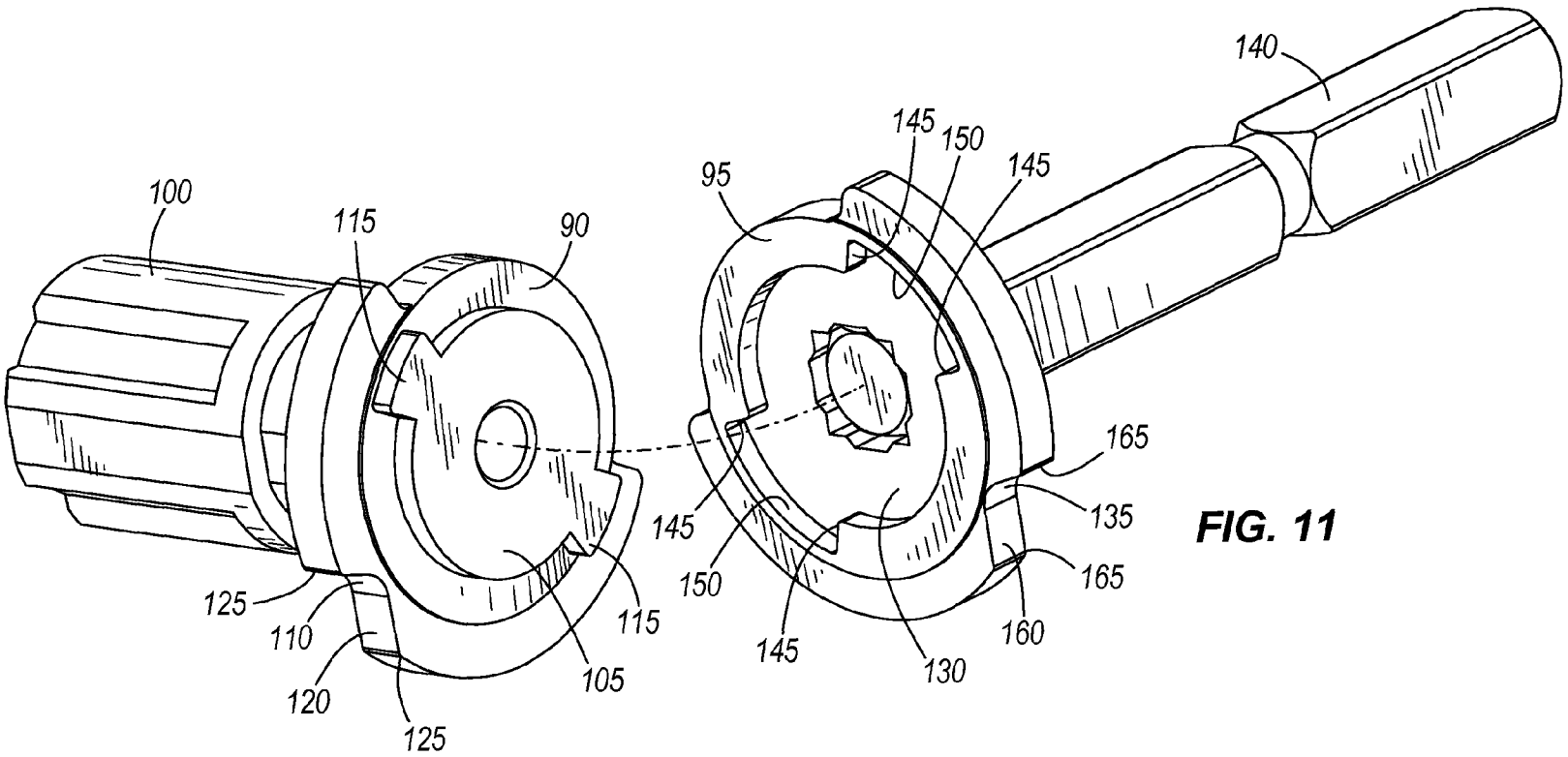
FIG. 11 is a perspective view of an internal hub and an exterior hub of the lock assembly.

As shown in FIGS. 2, 3, 9, 10, 19, and 20, the lock assembly 10 can be varied from the locked state to the unlocked state using the interior lock cylinder 290, the exterior lock cylinder 295, the keypad 20, or the second electronic button 495. With reference to FIGS. 9 and 10, upon rotation of the first plug 445 in the clockwise direction (e.g., 180 degrees) when the lock assembly 10 is in the locked state, the first cam portion 395 is engaged by the first cam 455 to rotate the interior drive member 270 another 45 degrees in the counter-clockwise direction to engage the first actuator 405 with the third engagement portion 355 a second time and to move the exterior lock bar 255 with the interior lock bar 260 and the link 265 from the second position to the first position. The first locator member 425 is displaced from the middle locator detent 370 (as viewed in FIGS. 9 and 10) to the uppermost locator detent 370 (as viewed in FIGS. 9 and 10) to hold the interior lock bar 260 in the first position. The second locator member 435 is displaced from the upper locator detent 305 (as viewed in FIGS. 9 and 10) to the lower locator detent 305 (as viewed in FIGS. 9 and 10) to hold the exterior lock bar 255 in the first position.

With reference to FIGS. 2, 3, 9, and 10, upon rotation of the second plug 475 in the clockwise direction when the lock assembly 10 is in the locked state, the third cam portion 420 is engaged by the third cam 485 to rotate the exterior drive member 275 approximately 45 degrees in the counter-clockwise direction, which rotates the interior drive member 270 a corresponding 45 degrees in the clockwise direction. In this manner, the first actuator 405 is engaged with the third engagement portion 355 to move the exterior lock bar 255 with the interior lock bar 260 and the link 265 from the second positions to the first positions as described above.

Figure 20:
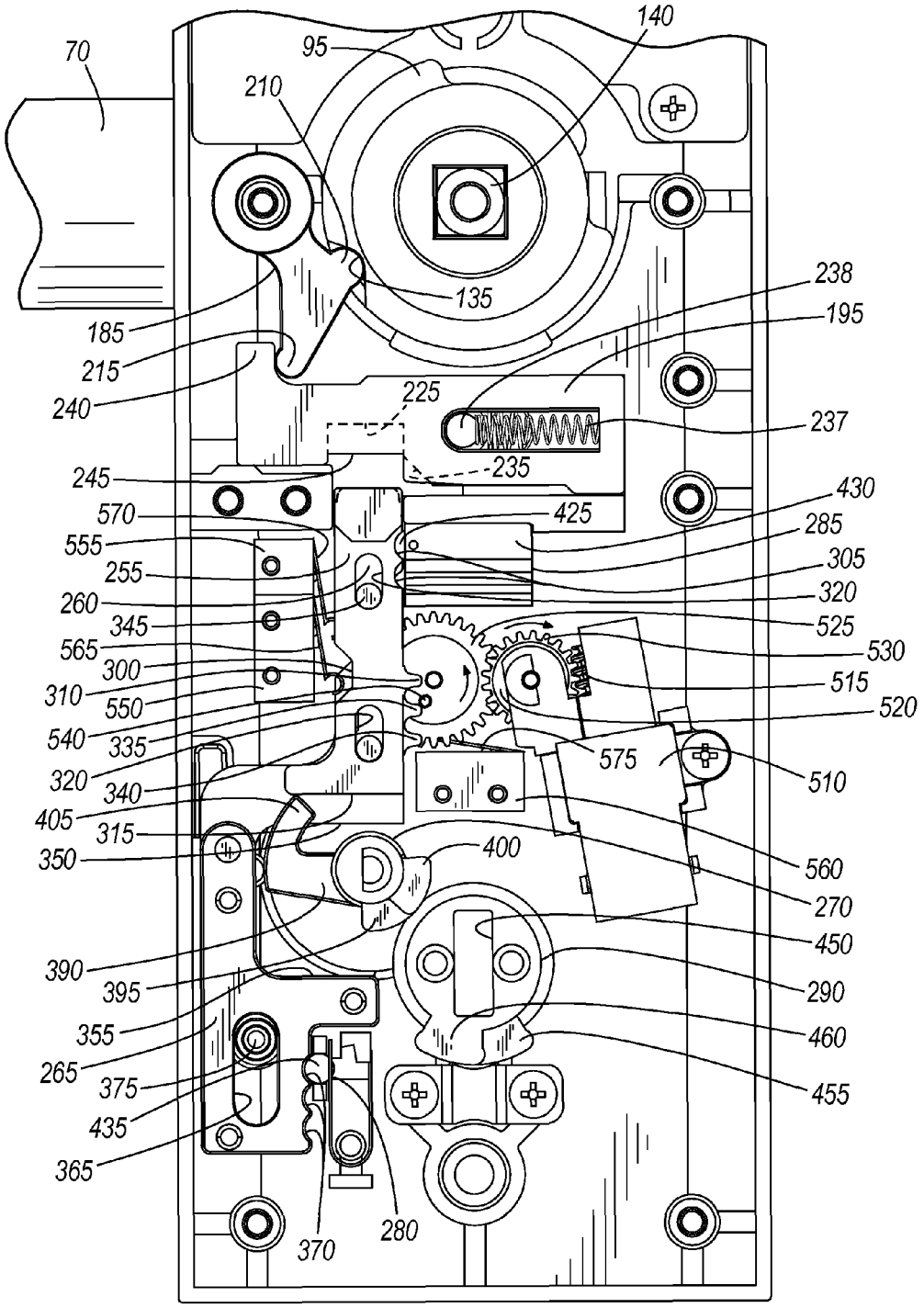
FIG. 20 is another rear view of the interior escutcheon illustrating the lock assembly varied to the unlocked state via the second engagement mechanism.
Figure 22:
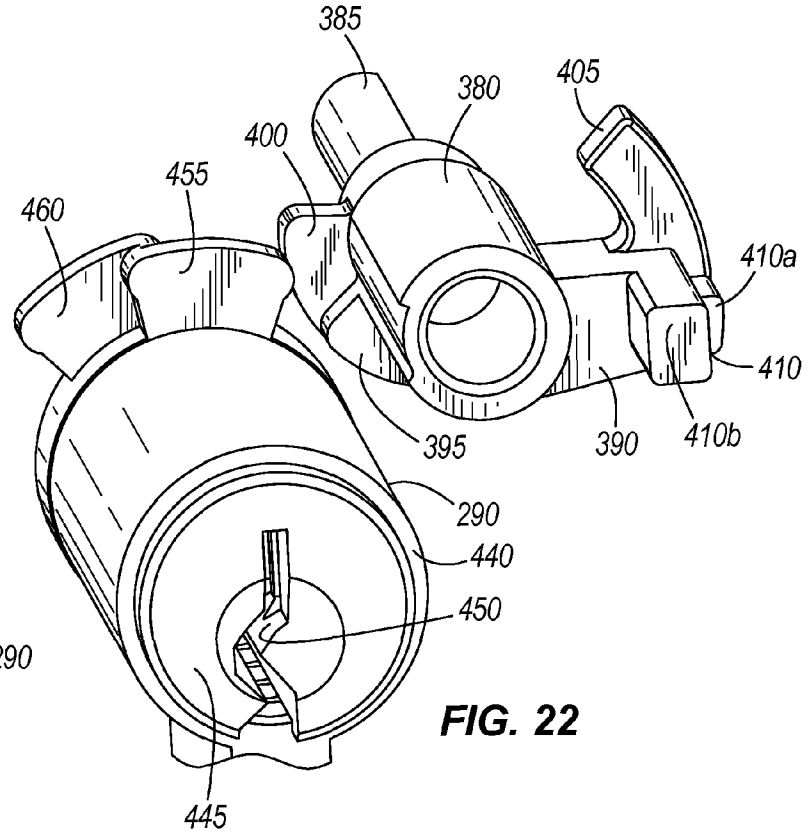
FIG. 22 is another perspective view of a portion of the lock assembly including the first engagement mechanism and the interior lock cylinder.
Figure 21:
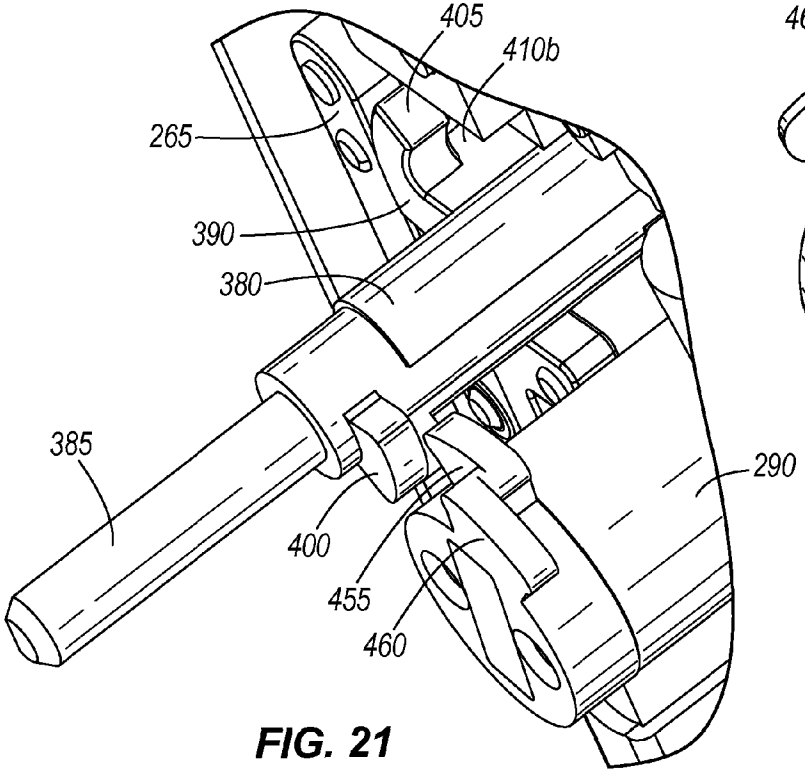
FIG. 21 is a perspective view of a portion of the lock assembly including the first engagement mechanism and an interior lock cylinder located adjacent the first engagement mechanism.

With reference to FIGS. 19 and 20, upon activation of the keypad 20 using an appropriate code or the first button 490, the motor 510 rotates the first gear 515 in a direction opposite the direction used to vary the lock assembly 10 from the unlocked state to the locked and deadlocked states. Rotation of the first gear 515 transfers to the third gear 525 via the second gear 520. The drive pin 540 rotates with the third gear 525 in the counter-clockwise direction such that the drive pin 540 engages the second tooth 335 to move the interior lock bar 260 with the exterior lock bar 255 from the respective second positions to the corresponding first positions. The first locator member 425 is displaced from the middle locator detent 370 (as viewed in FIGS. 19 and 20) to the uppermost locator detent 370 (as viewed in FIGS. 19 and 20) to hold the interior lock bar 260 in the first position. The second locator member 435 is displaced from the lower locator detent 305 (as viewed in FIGS. 19 and 20) to the upper locator detent 305 (as viewed in FIGS. 19 and 20) to hold the exterior lock bar 255 in the first position.

In some constructions, the lock assembly 10 is varied back to the locked state from the unlocked state a predetermined time after the lock assembly 10 is varied to the unlocked state (e.g., when egress through the door 15 is desired when the lock assembly 10 is in the locked state). In these constructions, the motor 510 is operated to re-engage the drive pin 540 with the first tooth 310 to move the interior and exterior lock bars 255, 260 to the second position, which varies the lock assembly 10 to the locked state. Operation of the motor 510 to vary the lock assembly 10 back to the locked state can be paused in response to a signal from the handle sensor 87 indicating that the interior handle 70 or the exterior handle 75 is in the active state. In other words, when the interior handle 70 or the exterior handle 75 is in the active state, the action of automatic returning the lock assembly 10 to the locked state from the unlocked state will be paused until the handle 70, 75 is sensed in the inactive state.

In some constructions, the thumbturn 465 can be used to vary the lock assembly 10 from the locked state to the unlocked state. Generally, rotation of the thumbturn 465 rotates the cam, which in turn engages the interior drive member 270 in the same manner as the first cam 455 and the second cam 460 to vary the interior lock bar 260 and link 265 from the second position to the first position in response to engagement of the first actuator 405 with the third engagement portion 355.

The controller determines the state of the lock assembly 10 based on signals from the first sensor 550 and the second sensor 555. In particular, the controller determines that the lock assembly 10 is in the unlocked state when the first sensor 550 and the second sensor 555 generate or transmit signals to the controller indicating that the respective sensors 550, 555 are inactive. The controller determines that the lock assembly 10 is in the locked state when the first sensor 550 generates or transmits a signal indicating that the first sensor 550 is active and the second sensor 555 generates or transmits a signal indicating that the second sensor 555 is inactive. The controller determines that the lock assembly 10 is in the deadlocked state when the first sensor 550 generates or transmits a signal indicating that the first sensor 550 is active and the second sensor 555 generates or transmits a signal indicating that the second sensor 555 is active.

With continued reference to FIG. 23, the third sensor 560 generates or transmits a signal to the controller indicating an orientation or location of the drive pin 540 relative to the exterior and interior lock bars 255, 260 to determine when rotation of the third gear 525 should be stopped via the motor 510 to achieve a desired orientation or position of the drive pin 540. When the cam member 545 engages or depresses the third sensor arm 575, the third sensor 560 generates or transmits a signal to the controller indicating the corresponding orientation of the drive pin 540. The motor 510 stops rotation of the third gear 525 when the desired orientation of the drive pin 540 is achieved based on the signal generated by the third sensor 560.

Figure 30:
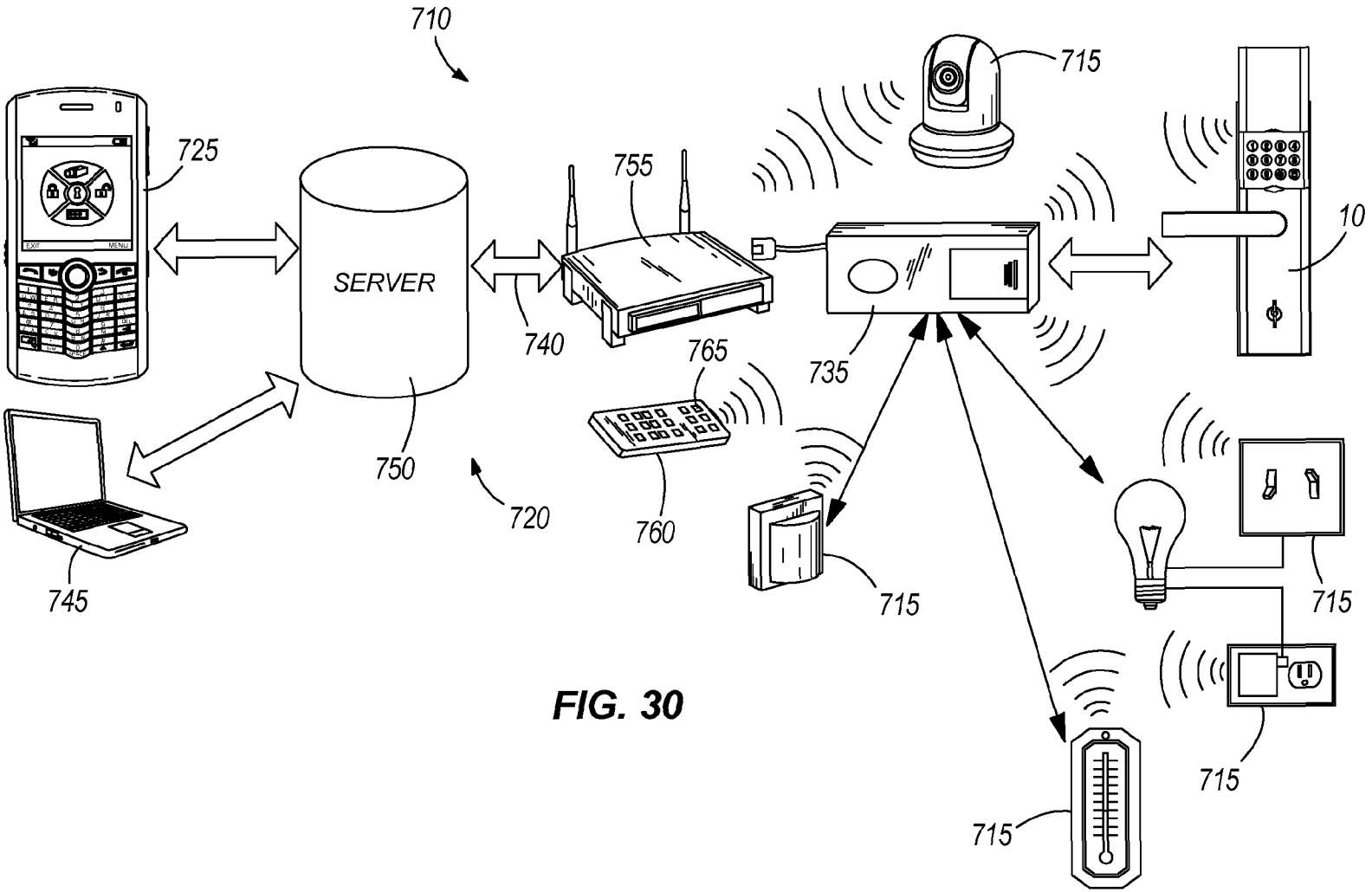
FIG. 30 is a diagram of a system for coupling a computer network, such as the Internet, to a radio-frequency (RF) mesh network using a gateway device to allow remote monitoring and control of RF mesh networked devices from a mobile device or a networked computer.
Figure 31:
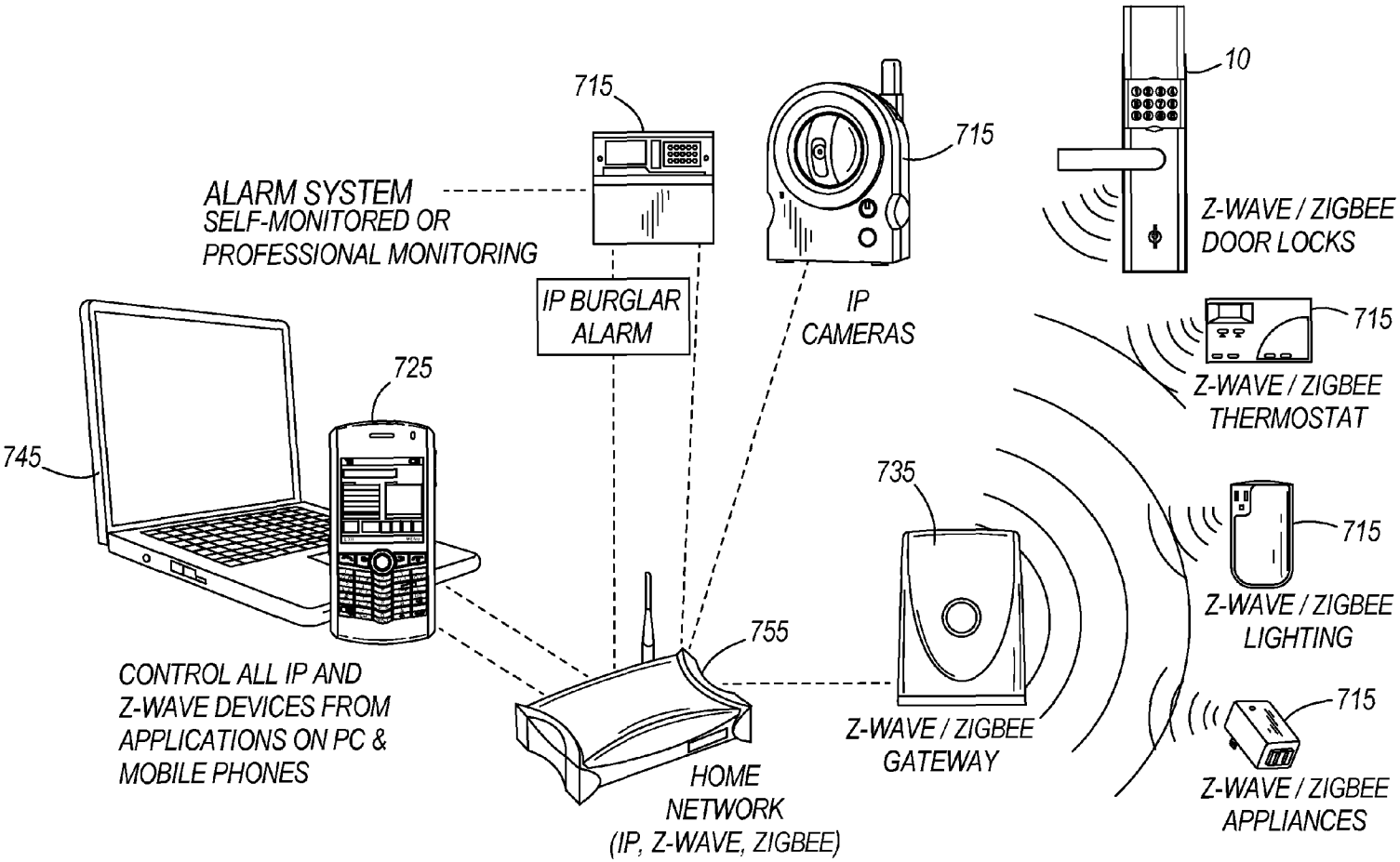
FIG. 31 is a diagram of the system of FIG. 30 including a networked computer server and additional RF mesh network devices.
Figure 32:
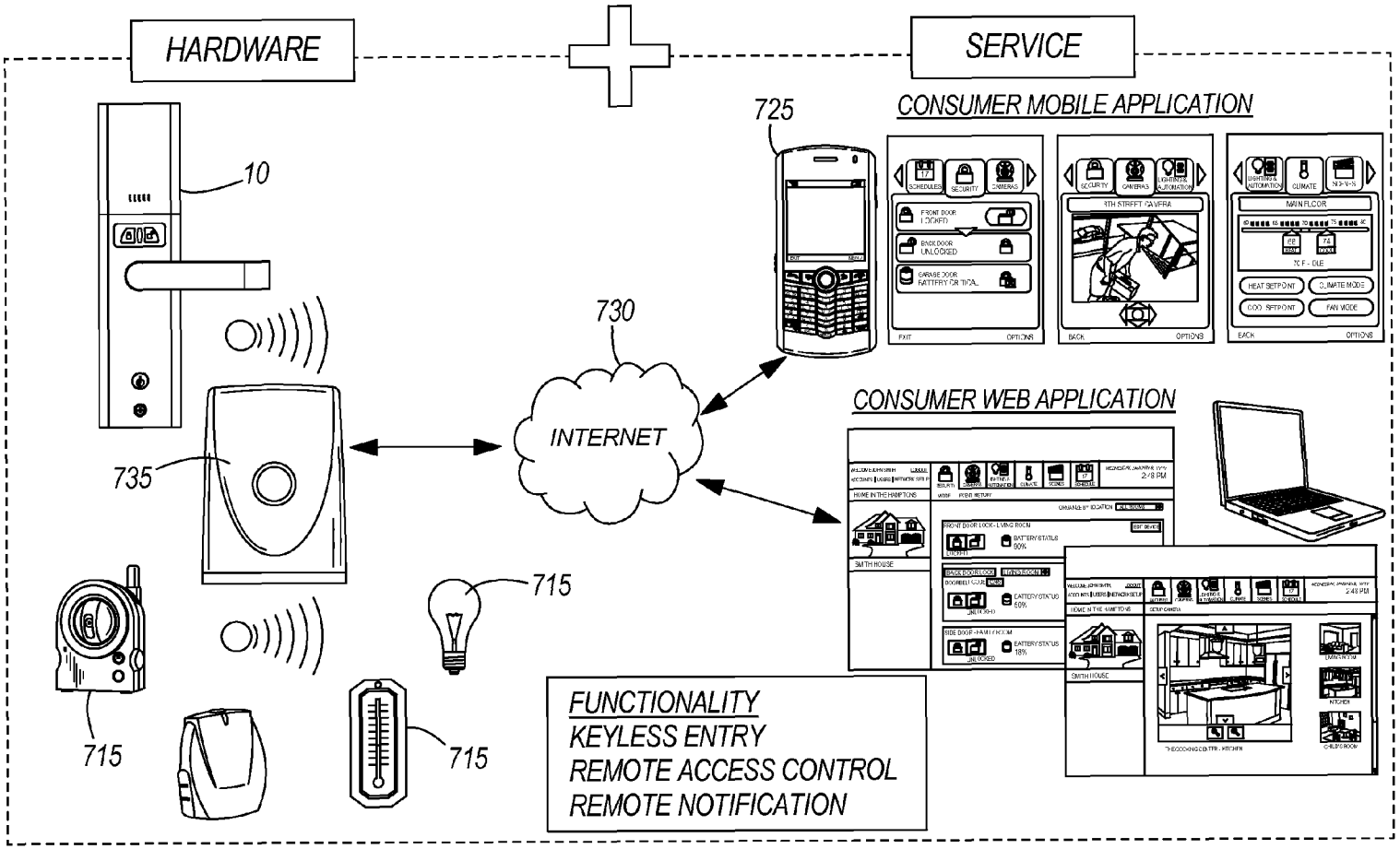
FIG. 32 is a diagram illustrating the communication between the RF devices, the Internet, a web application, and a mobile application.

In some constructions, the controller can include a wired or wireless control system that is located near the lock assembly 10, or at a remote location. For example, FIGS. 30-32 illustrate that the control system can include a network system 710 that monitors and controls the lock assembly 10 and other household devices 715 (e.g., deadbolts, cameras, lights, temperature controls, appliances, etc.). The network system 710 includes a radio frequency (RF) mesh network 720 (e.g., Z-WAVE, ZigBee, etc.) that can be coupled to a mobile device 725 via a computer network 730 (e.g., the Internet (FIG. 32)). An RF mesh network gateway device 735 couples the RF mesh network 720 to the computer network 730. The RF mesh network gateway device 735 may also generate signals in response to commands sent through the computer network connection 740 (e.g., from the mobile device 725 or another networked computer 745, which can be transferred via a networked computer server 750 (e.g., a web server that communicates with the mobile device 725 or the networked computer 745 using HyperText Transfer Protocol (HTTP) commands or other protocols suited for use via the Internet 730, using the gateway device 735 as the server, etc.) through a wireless router 755 or the computer network 730). Generally, the computer network 730 can include a home network (wired or wireless), an Internet network, a wide-area network, a local-area network, or other suitable network.

As shown in FIG. 30, a control device 760 can be used to directly control each device 10, 715 (e.g., by pressing a button 765 on the control device 760 to actuate an electrical controller (not shown) or activate a circuit that in turn may active the device 10, 715). Alternatively, the control device 760 may be programmed to automatically operate one or more devices 10, 715 based on a timer or based on the occurrence of a particular event (e.g. when a signal indicates that it is dark outside). As illustrated, the control device 760 is separate from the gateway device 735. In some constructions, the gateway device 735 can operate as the control device 760 or as another control device in conjunction with a separate, standalone control device 760.

To form the mesh network 720 with the devices 10, 715, the devices 10, 715 are initialized by the control device 760 or the RF mesh network gateway device 735 through a process referred to as 'learning in' of the device. Learning in a device 10, 715 into the mesh network 720 with the control device 760 or gateway device 735 synchronizes the device 10, 715 with the control device 760 or the gateway device 735. Prior to being incorporated into a network, an individual RF-controlled device may only transmit low-power radio signals, to avoid having the device inadvertently connect to a nearby but unrelated network. Given that uninitiated devices often transmit only low-power signals, the control device 760 or the gateway device 735 generally must be brought into sufficiently close proximity to an uninitiated device to be able to initiate wireless communications with the device and thus perform the enrollment (learning in) process. In some constructions, power levels are reduced during the "inclusion" or learning in process for the lock assembly 10. In other constructions, normal power learning in or inclusion may be utilized. Generally, low power inclusion or learning in has a range of approximately six feet, while normal power transmissions are in the one-hundred foot range. Of course, these ranges can vary widely due to environment and other factors.

Once brought into sufficiently close proximity to initiate wireless communications, the device 10, 715 exchanges information with the control device 760 or the gateway device 735 regarding the identity of the device 10, 715 and the local RF mesh network 720. In some constructions, the user takes steps to initiate the learning in process on one or both of the control device 760 or the gateway device 735 and the device 60, 62, 64, 66, so that a particular device is not inadvertently learned into the wrong network. The learning in process can be initiated using the device 10, 715, the control device 760, or the gateway device 735. After the device 10, 715 has been successfully added to the network 720, or 'learned in', the device's RF communication signals are then transmitted at higher power levels. The learned in device 10, 715 also rejects any signals that are received from other RF mesh networks. In some constructions, the control device 760 or the gateway device 735 indicates to the user that learning in has been successfully completed, for example by flashing an indicator light (e.g. an LED) or broadcasting a sound.

In the mesh network 20 (FIG. 1), each connected device 10, 715 acts as a communication node that can send and receive packets of information to any other device 10, 715 in the mesh network 720. If a particular packet of information is not addressed to the device that receives it, the device 10, 715 transmits the packet to the next device 10, 715, if necessary, and if configured to do so by the mesh network configuration. Collectively, the devices 10, 715 form a robust wireless network with redundancy and flexibility. In contrast to networks in which only a centralized hub can transmit packets, in the mesh network 720, the networked devices 10, 715 themselves provide multiple alternative pathways from the control device 760 to more remote devices in the network 720. Thus, the networked devices 10, 715 in the mesh network 720 can transmit signals around obstacles that would block direct transmission from a centralized hub. The devices 10, 715 in the RF mesh network 20 generally communicate with one another wirelessly, using radio frequency communications. However, other communication means (e.g., wired, infrared, etc.) can be used in place of or in conjunction with radio frequency communications. It should also be noted that the use of the mesh network 720 can increase battery life as the various components transmit RF signals at a lower power level when compared to standard wireless networks. The additional RF devices 10, 715 in the network can retransmit the signals such that each device only needs to transmit a signal a short distance, and thus a lower power transceiver is adequate.

In one construction, the RF mesh network devices 10, 715 communicate according to the Z-WAVE protocol. As part of its implementation of the mesh network 720, the Z-WAVE protocol includes procedures for routing of commands between networked devices to the correct final destination. Z-WAVE uses a two-way RF system that operates in the 908 MHz band in the United States. Z-WAVE is a bi-directional communication protocol. A message from node A to node C can be successfully delivered even if the two nodes are not within range providing that a third node (node B) can communicate with nodes A and C. If the preferred route is unavailable, the message originator will attempt other routes until a path is found to node C. Therefore, a Z-WAVE network can span much further than the radio range of a single unit. The more nodes in the mesh network 720, the more robust the network becomes. Z-WAVE is also low power when compared to other networks, thereby making it suitable for battery powered devices. Z-WAVE messages can also be encrypted using robust data encryption methods if desired. Other protocols for implementing an RF mesh network can be used as well, if desired.

With regard to the lock assembly 10, the mesh network signal is received by the lock assembly 10, which translates the signal into an appropriate operation (e.g., varying from one lock state to another lock state). In this way, the network system 710 can be used for remotely controlling access to an access point (e.g., the door 15). With this system, a radio-frequency mesh network transceiver is operatively coupled to the lock assembly 10 adjacent the door 15 to receive and transmit signals via the mesh network 720. The server is operatively connected to the computer network 730 and a remote communication device (e.g., the mobile device 725, the networked computer 745, etc.) that remotely monitors and operates the lock assembly 10.

Except as described below, the lock assembly 10 including the interior hub 580, the exterior hub 585, the interior slide member 590, and the exterior slide member 595 described with regard to FIGS. 27-29 operates the same as the lock assembly 10 described with regard to FIGS. 1-26.

When the lock assembly 10 is in the unlocked state, the exterior lock bar 255 is disengaged from the second slot 650 and the interior lock bar 260 is disengaged from the first slot 630. As a result, the latch 55 can be varied between the extended position and the retracted position when at least one of the interior handle 70 and the exterior handle 75 is rotated. Rotation of the interior handle 70 rotates the interior hub 580, which in turn moves the interior slide member 590 via engagement of the first pinion mechanism 600 with the first rack mechanism 620. Due to disengagement of the interior lock bar 260 from the first slot 630, the interior handle 70 can be further rotated to retract the latch 55. The latch 55 returns to the extended position upon release of the interior handle 70 (i.e., after the interior handle 70 returns to the inactive state). In particular, the bias of the interior slide member 590 cooperates with rotation of the interior handle 70 to re-center the interior slide member 590 such that the first slot 630 is re-aligned with the second slot 650.

Rotation of the exterior handle 75 when the lock assembly 10 is in the unlocked state rotates the exterior hub 585, which in turn moves the exterior slide member 595 via engagement of the second pinion mechanism 610 with the second rack mechanism 640. Due to disengagement of the exterior lock bar 255 from the second slot 650, the exterior handle 75 can be further rotated to retract the latch 55. The latch 55 returns to the extended position upon release of the exterior handle 75 (i.e., after the interior handle 75 returns to the inactive state). In particular, the bias of the exterior slide member 595 cooperates with rotation of the interior handle 75 to re-center the exterior slide member 595 such that the second slot 650 is re-aligned with the first slot 630.

The exterior handle 75 is inoperable to gain access through the door 15 when the lock assembly 10 is in the locked state. Due to the lost rotative motion between the interior hub 580 and the exterior hub 585, the interior hub 585 rotates the angular distance D1 without causing rotation of the exterior hub 585. Because the lock assembly 10 is in the locked state, the exterior slide member 595 only moves a distance (not shown) corresponding to the angular distance D1 due to engagement of the exterior lock bar 255 with the exterior slide member 595 within the second slot 650. Movement of the exterior slide member 595 only a slight amount means that the exterior handle 75 cannot rotate more than the angular distance D1. The angular distance D1 merely provides some "play" or slight movement of the exterior handle 75. The angular distance D1 is insufficient to disengage the exterior lock bar 255 from the exterior slide member 595. As a result, the exterior handle 75 cannot be used to vary the latch 55 from the extended position to the retracted position when the lock assembly 10 is in the locked state.

The interior handle 70 can be rotated to retract the latch 55 and gain access through the door 15 when the lock assembly 10 is in the locked state. Due to the lost rotative motion between the interior hub 580 and the exterior hub 585, the interior hub 580 rotates the angular distance D1 without causing rotation of the exterior hub 585. The rotation of the interior hub 580 relative to the exterior hub 585 slides the interior slide member 590 a distance corresponding to the angular distance D1 such that the chamfered portion 635 is engaged with the first end of the interior lock bar 260. Upon further rotation of the interior handle 70, the first end of the interior lock bar 260 is displaced from the first slot 630, which displaces or disengages the exterior lock bar 255 from the second slot 650 of the exterior slide member 595 due to the relationship between the pin channels 320 and the pins 345. In this manner, access through the door 15 when the lock assembly 10 is in the locked state can be provided in response to activation of the interior handle 70, but not in response to activation of the exterior handle 75.

When the lock assembly 10 is in the deadlocked state, the exterior handle 75 and the interior handle 70 are inoperable to gain access through the door 15. Specifically, the interior slide member 590 is substantially immovable due to engagement of the first end of the interior lock bar 260 with the first slot 630, and the exterior slide member 595 is substantially immovable due to engagement of the first end of the exterior lock bar 255 with the second slot 650. Because the interior slide member 590 and the exterior slide member 595 are substantially immovable, the interior and exterior hubs 580, 580 are substantially immovable and the interior and exterior handles 70, 75 can only rotate the distance D1 corresponding to the lost rotative motion between the interior hub 580 and the exterior hub 585. The "play" provided by the angular distance D1 does not displace or disengage the exterior lock bar 255 from the exterior slide member 595, and the angular distance D1 does not displace or disengage the interior lock bar 260 from the interior slide member 590. As a result, the interior handle 70 and the exterior handle 75 cannot be rotated to fully retract the latch 55 when the lock assembly 10 is in the deadlocked state. Instead, the latch 55 remains in the extended position when the lock assembly 10 is in the deadlocked state regardless of whether the interior handle 70 or the exterior handle 75 is engaged.

Various features and advantages of the invention are set forth in the following claims.

What is claimed is:

1. A lock assembly having an unlocked state, a locked state, and a deadlocked state, the lock assembly comprising:

a latch assembly having a latch movable between an extended position and a retracted position;

an interior handle operatively coupled to the latch to move the latch between the extended position and the retracted position;

an interior hub coupled to the interior handle for rotation therewith;

an exterior handle operatively coupled to the latch to move the latch between the extended position and the retracted position;

an exterior hub coupled to the exterior handle for rotation therewith;

a first member operatively coupled to the interior handle to permit or prevent movement of the interior handle;

a second member operatively coupled to the exterior handle to permit or prevent movement of the exterior handle;

an interior lock element engageable with the first member; and an exterior lock element engageable with the second member, wherein when the lock assembly is in the unlocked state, the interior lock element is disengaged from the first member and the exterior lock element is disengaged from the second member to permit retraction of the latch via the interior handle or the exterior handle, wherein when the lock assembly is in the locked state, the exterior lock element is engaged with the second member to prevent retraction of the latch via the exterior handle, and wherein when the lock assembly is in the deadlocked state, the interior lock element is engaged with the first member to prevent retraction of the latch via the interior handle and the exterior lock element is engaged with the second member to prevent retraction of the latch via the exterior handle.

2. The lock assembly of claim 1, wherein the first member is engaged with the interior hub to permit movement of the interior hub when the interior lock element is disengaged from the first member, and to prevent movement of the interior hub when the interior lock element is engaged with the first member, and wherein the second member is engaged with the exterior hub to permit movement of the exterior hub when the exterior lock element is disengaged from the second member, and to prevent movement of the exterior hub when the exterior lock element is engaged with the second member.

3. The lock assembly of claim 2, wherein the exterior hub is engaged with the interior hub such that an initial lost rotative motion exists between the interior hub and the exterior hub, and wherein in the locked state, the first member is movable relative to the second member a distance corresponding to the initial lost rotative motion to disengage the interior lock element from the first member and to disengage the exterior lock element from the second member.

4. The lock assembly of claim 3, wherein the first member includes a slot and a chamfered portion located adjacent the slot, and wherein in the locked state, an end of the interior lock element is engaged by the chamfered portion in response to movement of the first member by the interior hub to disengage the interior lock element from the first member and to disengage the exterior lock element from the second member.

5. The lock assembly of claim 2, wherein the first member includes a first slot and the second member includes a second slot, and wherein in the locked state, an end of the exterior lock element is engaged with the second slot such that the second member is substantially immovable.

6. The lock assembly of claim 5, wherein in the deadlocked state, an end of the interior lock element is engaged with the first slot such that the first member is substantially immovable, and wherein an end of the exterior lock element is engaged with the second slot such that the second member is substantially immovable.

7. The lock assembly of claim 6, wherein the first member prevents rotation of the interior hub when the interior lock element is engaged with the first slot and the second member prevents rotation of the exterior hub when the exterior lock element is engaged with the second slot.

8. The lock assembly of claim 1, wherein the interior lock element is coupled to the exterior lock element, wherein the interior lock element is movable with the exterior lock element between a first position corresponding to the unlocked state and a second position corresponding to the locked state, and wherein the interior lock element is movable relative to the exterior lock element between the second position and a third position corresponding to the deadlocked state.

9. The lock assembly of claim 8, further comprising an actuator mechanism located adjacent one of the interior handle and the exterior handle; and an engagement mechanism including an engagement member engageable by the actuator mechanism to move the exterior lock element and the interior lock element between the first position and the second position, and to move the interior lock element between the second position and the third position.

10. The lock assembly of claim 9, wherein the actuator mechanism includes one of a thumbturn and a lock cylinder having a key-actuated plug.

11. The lock assembly of claim 8, further comprising at least one locator biased into engagement with one of the exterior lock element and the interior lock element to hold the corresponding lock element in the first position, the second position, or the third position.

12. The lock assembly of claim 1, further comprising a motor operable in response to a signal to engage and disengage the interior lock element relative to the first member and to engage and disengage the exterior lock element relative to the second member.

13. The lock assembly of claim 12, wherein the motor is in communication with at least one of a keypad and a remote network control system, and wherein the motor is operable in response to a signal from at least one of the keypad and the remote network control system to vary the lock assembly between the unlocked state, the locked state, and the deadlocked state.

14. The lock assembly of claim 12, further comprising a button accessible from and located adjacent the interior handle, wherein the motor is operable in response to a signal from the button.

15. The lock assembly of claim 12, wherein the exterior lock element includes a first tooth and the interior lock element includes a second tooth, and wherein the lock assembly further includes an engagement mechanism rotatable in a first direction and a second direction opposite the first direction in response to operation of the motor, the engagement mechanism selectively engageable with the first tooth and the second tooth to move the interior lock element into and out of engagement with the first member, and to move the exterior lock element into and out of engagement with the second member.

16. The lock assembly of claim 15, wherein the engagement mechanism is rotatable in a first direction into engagement with at least one of the first tooth and the second tooth to vary the lock assembly from the unlocked state, and wherein the engagement mechanism is rotatable in a second direction opposite the first direction into engagement with at least one of the first tooth and the second tooth to vary the lock assembly to the unlocked state.

17. A lock system comprising:

a lock assembly variable between an unlocked state, a locked state, and a deadlocked state, the lock assembly including a latch assembly having a latch movable between an extended position and a retracted position;

an interior handle operatively coupled to the latch to move the latch between the extended position and the retracted position;

an exterior handle operatively coupled to the latch to move the latch between the extended position and the retracted position;

a first member operatively coupled to the interior handle to permit or prevent movement of the interior handle;

a second member operatively coupled to the exterior handle to permit or prevent movement of the exterior handle;

an interior lock element engageable with the first member;

an exterior lock element engageable with the second member; and a network system including a mesh network in communication with the lock assembly, the lock assembly responsive to a remote signal from the mesh network such that the interior lock element is engaged with the first member and the exterior lock element is engaged with the second member, the lock assembly further responsive to another remote signal from the mesh network such that the interior lock element is disengaged from the first member and the exterior lock element is disengaged from the second member, wherein the lock assembly is in one of the locked state and the deadlocked state when the interior lock element is engaged with the first member and the exterior lock element is engaged with the second member to prevent retraction of the latch via at least the exterior handle, and wherein the lock assembly is in the unlocked state when the interior lock element is disengaged from the first member and the exterior lock element is disengaged from the second member to permit retraction of the latch via the interior handle or the exterior handle.

18. The lock system of claim 17, wherein when the lock assembly is in the deadlocked state, the interior lock element is engaged with the first member to prevent retraction of the latch via the interior handle and the exterior lock element is engaged with the second member to prevent retraction of the latch via the exterior handle.

19. The lock system of claim 17, further comprising a motor operable in response to signals from the mesh network to engage and disengage the interior lock element relative to the first member and to engage and disengage the exterior lock element relative to the second member.

20. The lock system of claim 19, wherein the exterior lock element includes a first engagement portion engageable via operation of the motor to move the exterior lock element and the interior lock element from a first position corresponding to the unlocked state to a second position corresponding to the locked state.

21. The lock system of claim 20, wherein the interior lock element includes a second engagement portion engageable by operation of the motor to move the interior lock element from the second position to a third position corresponding to the deadlocked state.

* * * * *